US008225758B2

(12) United States Patent
Lee et al.

(10) Patent No.: US 8,225,758 B2
(45) Date of Patent: Jul. 24, 2012

(54) CONTINUOUSLY VARIABLE VALVE LIFT SYSTEM FOR ENGINES AND CONTROLLING METHOD THEREOF

(75) Inventors: Eunho Lee, Hwaseong-si (KR); Younghong Kwak, Suwon-si (KR); Kiyoung Kwon, Seoul (KR); Jinkook Kong, Suwon-si (KR); Soohyung Woo, Yongin-si (KR); Kyoungjoon Chang, Seongnam-si (KR)

(73) Assignee: Hyundai Motor Company, Seoul (KR)

( * ) Notice: Subject to any disclaimer, the term of this patent is extended or adjusted under 35 U.S.C. 154(b) by 530 days.

(21) Appl. No.: 12/471,142

(22) Filed: May 22, 2009

(65) Prior Publication Data

US 2009/0288623 A1 Nov. 26, 2009

(30) Foreign Application Priority Data

May 22, 2008 (KR) ..... 10-2008-0047713
Sep. 3, 2008 (KR) ..... 10-2008-0086820

(51) Int. Cl.
*F01L 1/34* (2006.01)

(52) U.S. Cl. ..... 123/90.16; 123/90.39; 74/559

(58) Field of Classification Search ..... 123/90.16, 123/90.39; 74/559, 569
See application file for complete search history.

(56) References Cited

U.S. PATENT DOCUMENTS

| | | | |
|---|---|---|---|
| 6,378,474 | B1 | 4/2002 | Pierik |
| 2006/0011160 | A1 | 1/2006 | Methley |

FOREIGN PATENT DOCUMENTS

| | | | | |
|---|---|---|---|---|
| JP | 2004-10555 | A | | 4/2004 |
| JP | 2006105082 | A | * | 4/2006 |
| JP | 2007-170333 | A | | 7/2007 |
| KR | 10-2006-0018889 | A | | 3/2006 |
| KR | 10-2006-0043730 | A | | 5/2006 |
| KR | 10-0663215 | B1 | | 1/2007 |
| KR | 10-2008-0025819 | A | | 3/2008 |

* cited by examiner

*Primary Examiner* — Zelalem Eshete
(74) *Attorney, Agent, or Firm* — Morgan, Lewis & Bockius LLP

(57) ABSTRACT

The present invention relates to a continuously variable valve lift system for engines, which can prevent deterioration of fuel efficiency due to a friction loss by a return spring even in a low lift operation state by making a high lift swing angle be larger than a low lift swing angle, easily implement the CVVL by reducing a lost motion angle to an optimum condition, and securely generate an advancing effect in spite of reduction of the lost motion angle. Further, the continuously variable valve lift system is easy and convenient to adjust a clearance of an oscillating cam link, prevent the clearance of the oscillating cam link from being accumulated, and has a convenience of workability in adjusting the clearance in a narrow engine room.

16 Claims, 25 Drawing Sheets

(a)

(b)

CONTINUOUSLY VARIABLE VALVE LIFT SYSTEM FOR ENGINES AND CONTROLLING METHOD THEREOF

CROSS-REFERENCE TO RELATED APPLICATIONS

The present application claims priority to Korean Patent Application Numbers 10-2008-0047713 and 10-2008-0086820 filed May 22, 2008 and Sep. 3, 2008, respectively, the entire contents of which applications are incorporated herein for all purposes by these references.

BACKGROUND OF THE INVENTION

1. Field of the Invention

The present invention relates to a continuously variable valve lift system for engines and a controlling method thereof.

2. Description of Related Art

Generally, intake and exhaust valves of an engine have functions to control flow of intake air and exhaust air in a cylinder and maintain airtightness in the cylinder.

That is, both the intake valve and the exhaust valve are closed in a compression stroke and an explosion stroke to maintain the airtightness in the cylinder and the intake valve or the exhaust valve is opened in an intake stroke and the exhaust stroke to take in fuel gas and exhaust combustion gas.

A cam formed in a cam shaft presses ends of the valves through a rocker arm (swing arm) to close and open the valves. The cam shaft rotates by receiving a rotational force of a crankshaft via a timing chain or a timing belt.

Meanwhile, a primary element to determine the airtightness of the valves, amounts of intake gas and exhaust gas, etc. is valve lift, which means a distance in which a valve face is distant from a valve seat.

In general, in the case of the intake valve, as the valve lift is larger, an amount of outside air or fuel gas which is introduced into the cylinder increases in the intake stroke. Contrary to this, in the case of the exhaust valve, as the valve lift is larger, the amount of combustion gas exhausted in the exhaust stroke increases, thereby improving intake and exhaust efficiencies.

Meanwhile, it is a continuously variable valve lift that can continuously vary the valve lift by using a motor and a device having a predetermined configuration.

The continuously variable valve lift (hereinafter, referred to as 'CVVL') has been developed in various forms for each automobile manufacturer. Although the CVVL has different names for each automobile manufacturer, each automobile manufacturer has an object to improve an effect (improving engine output and enhancing fuel efficiency) of the CVVL by smoothly switching a high valve lift operation state and a low valve lift operation state into each other and controlling the high and low valve lift operations and a lost motion angle.

However, when a low lift swing angle is larger than a high lift swing angle in the CVVL, a friction loss increases by a return spring during the low lift operation, such that fuel efficiency is deteriorated.

Further, the known CVVL does not have an advancing function of a valve timing or even though the CVVL has the advancing function, the lost motion angle excessively increase, the continuously variable valve lift having the advancing function is difficult to actually implement.

Further, in the case of the CVVL, an assembly clearance is generated at the time of assembling a connection shaft and an oscillating cam link. A difference between a valve profile in an initial design and a valve profile measured in an actual usage is generated due to the assembly clearance.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a continuously variable valve lift system for engines and a controlling method thereof that prevent deterioration of fuel efficiency due to a friction loss by making a high lift swing angle be larger than a low lift swing angle through smooth switching of high and low valve lift operation states and a precision control of valve lift and a lost motion angle, easily implement a CVVL by reducing the lost motion angle to an optimum condition, and securely generate an advancing effect in spite of reduction of the lost motion angle.

In an aspect of the present invention, a continuously variable valve lift system for engines, may include an eccentric cam connected to an eccentric cam shaft wherein a shaft center of the eccentric cam is offset from a shaft center of the eccentric cam shaft, a rocker arm rotatably receiving the eccentric cam therein so that the rocker arm is eccentrically rotatable about the eccentric cam shaft according to rotation of the eccentric cam, an oscillating cam rotatably coupled to the eccentric cam shaft, an oscillating cam link pivotally coupling one end portion of the rocker arm and one end portion of the oscillating cam with each other, a variable lever, one end portion of which is rotatably coupled to the eccentric cam shaft, and a link device linking the other end portion of the rocker arm and the other end portion of the variable lever with each other.

The system may further include an elastic member that elastically supports the oscillating cam toward a driving cam.

The one end portion of the rocker arm and one end portion of the oscillating cam link may be connected to each other via a connection shaft and the rocker arm and the oscillating cam link may be spaced from each other in a longitudinal direction of the connection shaft and are hinge-joined with the connection shaft.

In another aspect of the present invention, the link device may include a variable lever link, one end portion of which is rotatably coupled to the other end portion of the rocker arm, a middle portion of which is rotatably coupled to the other end portion of the variable lever, and the other end portion of which contacts with a driving cam.

In further another aspect of the present invention, the link device may include a variable lever link, one end portion of which is hinge-joined to a variable lever link shaft coupled to the other end portion of the variable lever, and an oscillating roller link, one of which is rotatably coupled to the other end portion of the rocker arm and the other end portion of which is hinge-joined to the variable lever link, wherein an oscillating roller is installed at a connection portion between the variable lever link and the oscillating roller link, wherein the variable lever link shaft is hinge-joined with the other end portion of the variable lever, wherein the connection shaft and the variable lever link shaft are installed parallel to the eccentric cam shaft, respectively, and wherein the oscillating roller is installed at the other end portion of the oscillating roller link.

In yet another aspect of the present invention, a continuously variable valve lift system for engines, may include a link device that transmits a rotation force of a driving cam to a link member to control a lift length of a valve, and an adjusting unit that connects the link member with the link device and is locked after adjusting tolerance between the link devices, wherein the link member is a rocker arm that rotatably receiving an eccentric cam installed to be eccentric to an eccentric cam shaft, wherein the link device is an oscillating cam link that interlocks the link member with an oscillating cam, and wherein the adjusting unit includes a connection shaft that has a pin cam provided on an outer circumferential surface thereof to be eccentric and penetrates and connects the link member and the link device with each other so that the link device is positioned in the pin cam.

The system may further include a rotation preventing member that is installed in the link member so as to be in contact and non-contact with the adjusting unit and prevents axial rotation of the adjusting unit when being in contact with the adjusting unit, wherein a protrusion that contacts the rotation preventing member is formed on an outer circumferential surface of the adjusting unit in a circumferential direction of the adjusting unit, wherein the rotation preventing member includes a lock that is inserted into and installed in a mounting portion of the link member and has a protrusion engaging portion engaged and joined with the adjusting unit, which is formed on the bottom thereof, and a lock adjuster that is integrally joined to the lock, wherein the rotation preventing member is screw-joined to the link member, and wherein a gear-shape or hemisphere-shape protrusion is formed in the adjusting unit in a circumferential direction or an axially longitudinal direction of the adjusting unit, and a protrusion engaging portion having a gear shape or a recessed groove shape that corresponds to the protrusion shape of the adjusting unit is formed in the rotation preventing member.

In another aspect of the present invention, a controlling method of a continuously variable valve lift system for vehicle engines may include detecting a state of an engine, controlling opening and closing timings and valve lift of intake and exhaust valves depending on calculation values of the opening and closing timings and valve lift of the intake and exhaust valves, which are calculated in the step, detecting changes of the opening and closing timings and valve lift of the intake and exhaust valves, which are performed in the step, and by comparing the change values of the opening and closing timings and valve lift of the intake and exhaust valves, which are detected in the step with the calculation values, terminating a control operation when a difference therebetween is within a set error and repetitively performing steps after calculating the opening and closing timings and valve lift of the intake and exhaust valves that correspond to a load condition when the difference is deviated from the set error, wherein detecting the state of the engine includes detecting engine RPM, a throttle opening degree, and a change of an intake pressure when a start-up is on, determining a current load condition of a vehicle, which corresponds to the detected engine RPM, throttle opening degree and the change of the intake pressure, and calculating opening and closing timings and valve lift of the intake and exhaust valves, which correspond to the determined load condition.

A CVVL in various aspects of the present invention can prevent deterioration of fuel efficiency due to a friction loss by a return spring even in a low lift operation state by making a high lift swing angle be larger than a low lift swing angle, easily implement the CVVL by reducing a lost motion angle to an optimum condition, and securely generate an advancing effect in spite of reduction of the lost motion angle.

Further, the CVVL in various aspects of the present invention is easy and convenient to adjust an assembly clearance of an oscillating cam link, prevent the assembly clearance of the oscillating cam link from being accumulated, and has a convenience of workability in adjusting the assembly clearance in a narrow engine room.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Figure 1:
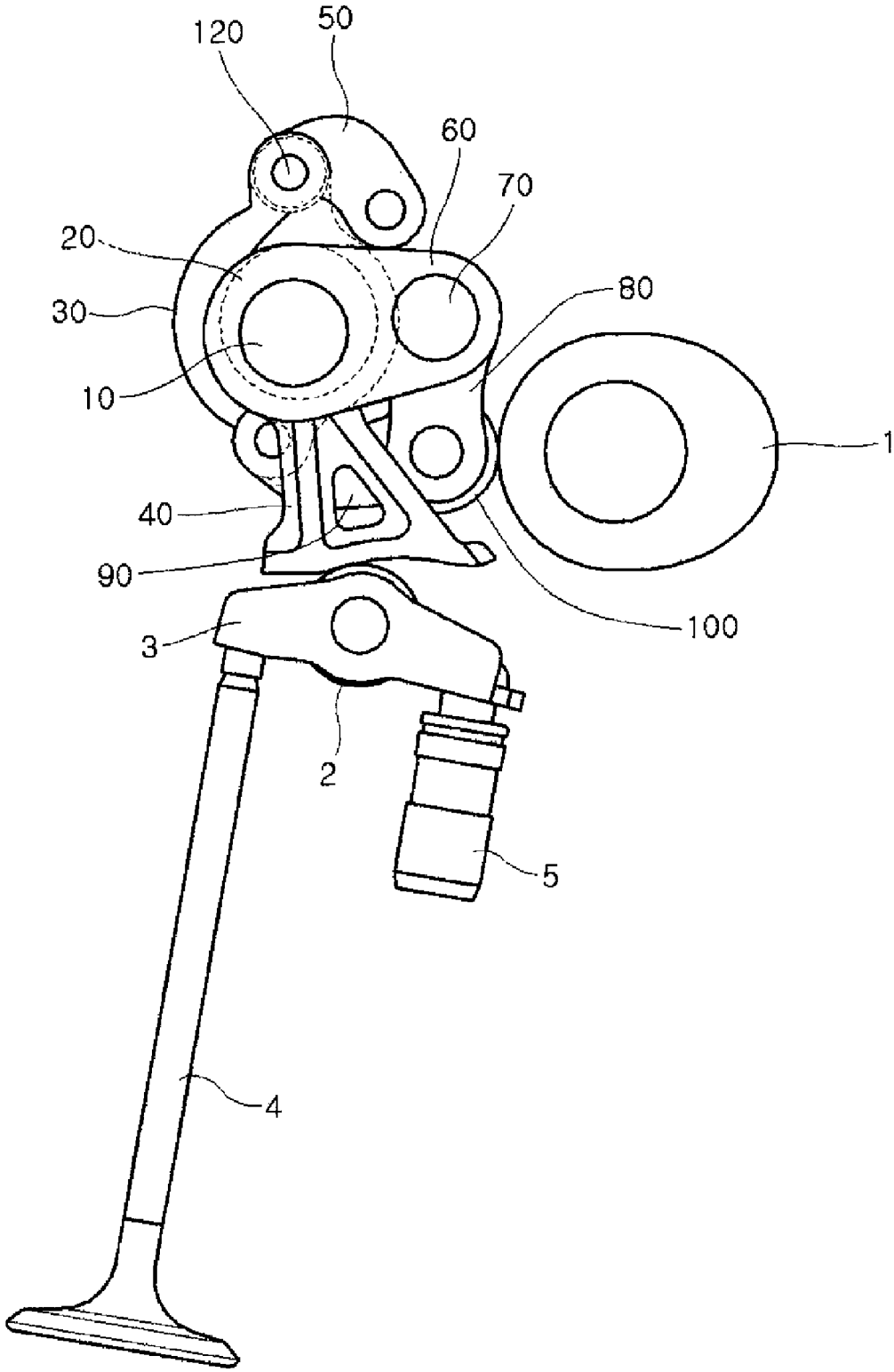
FIG. 1 is a front view of an exemplary CVVL according to the present invention.
Figure 2:
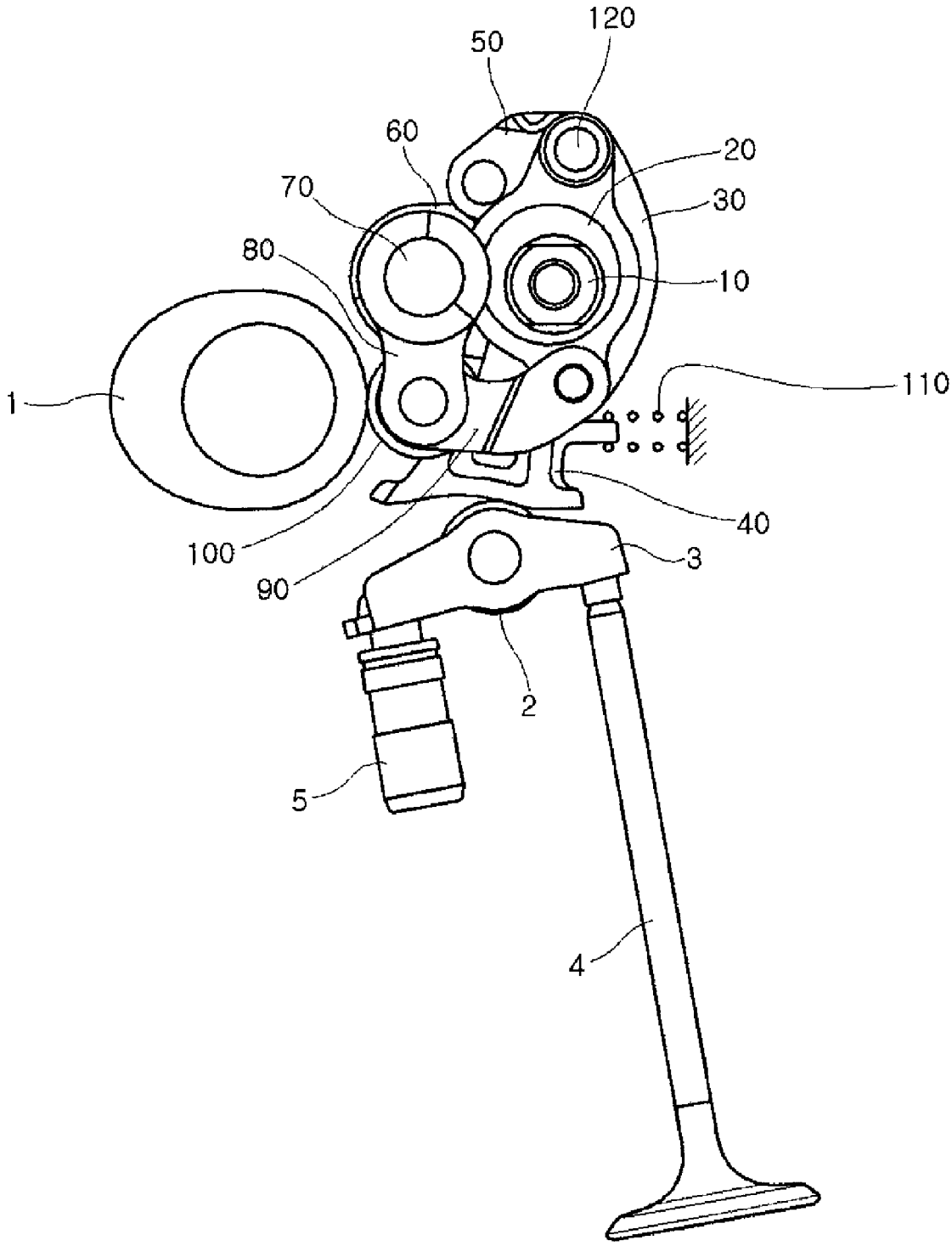
FIG. 2 is a rear view of FIG. 1.
Figure 3:
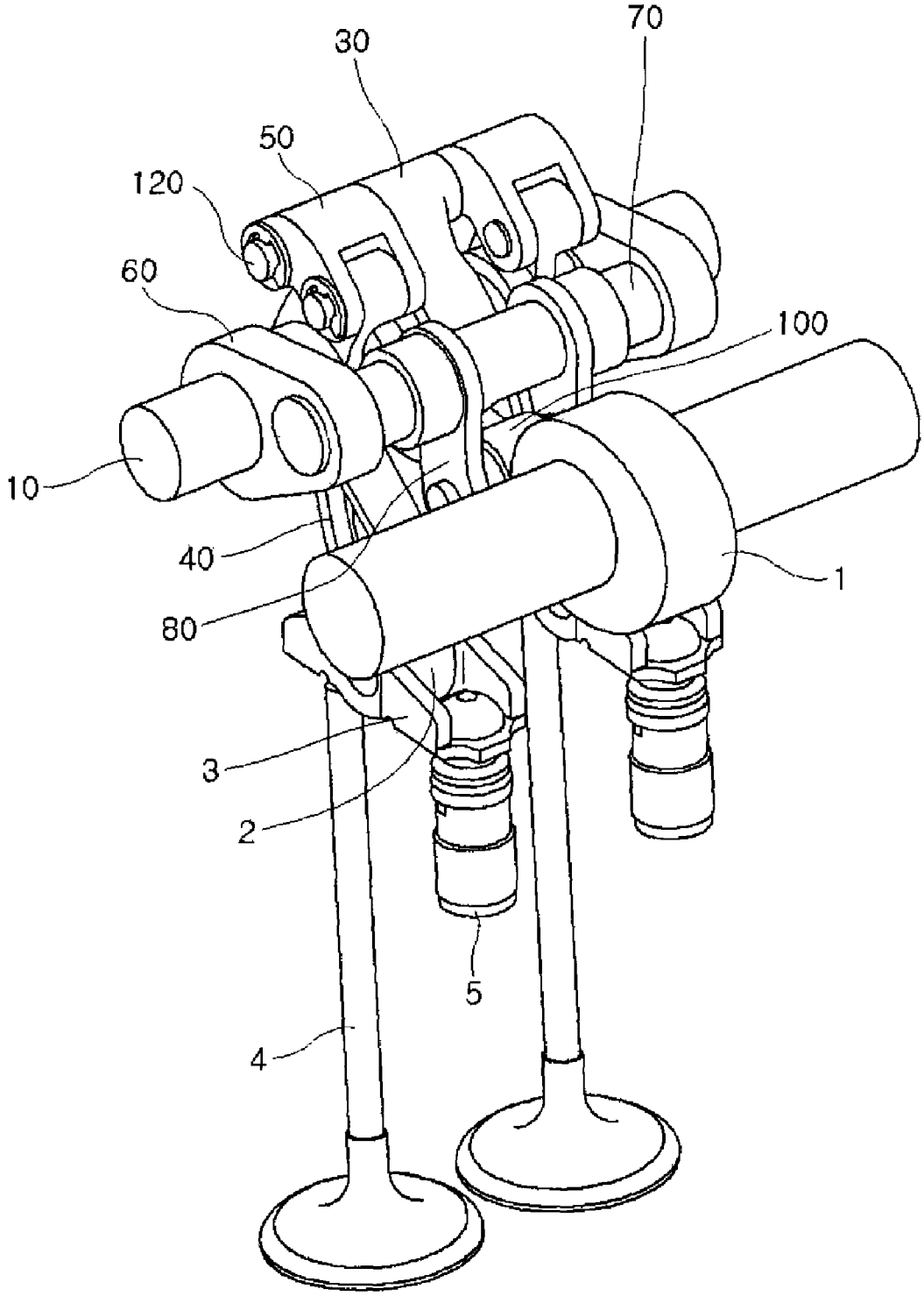
FIG. 3 is a perspective view of an exemplary CVVL according to the present invention.
Figure 4:
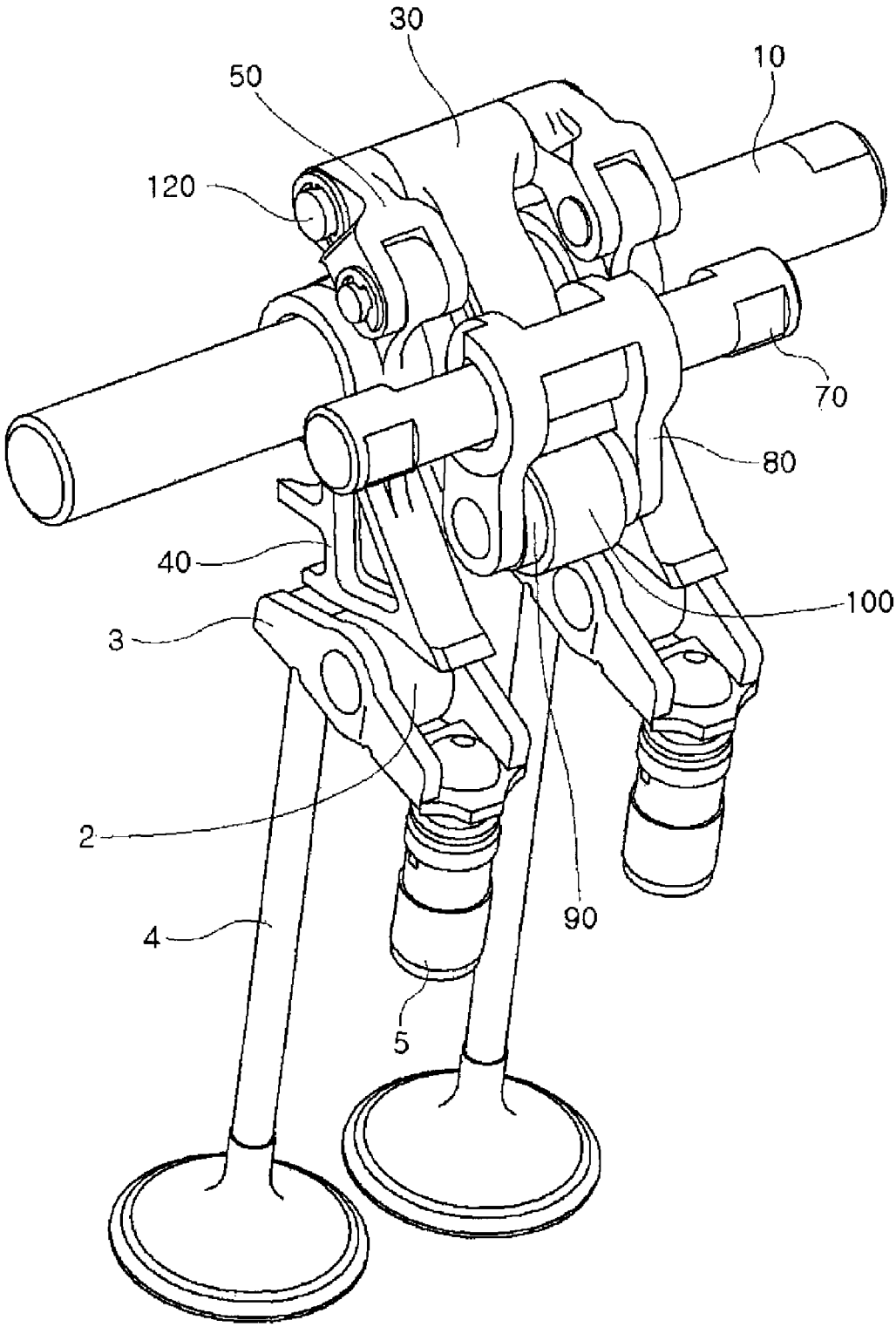
FIG. 4 is a perspective view of a state in which a variable lever is removed in FIG. 3.
Figure 5:
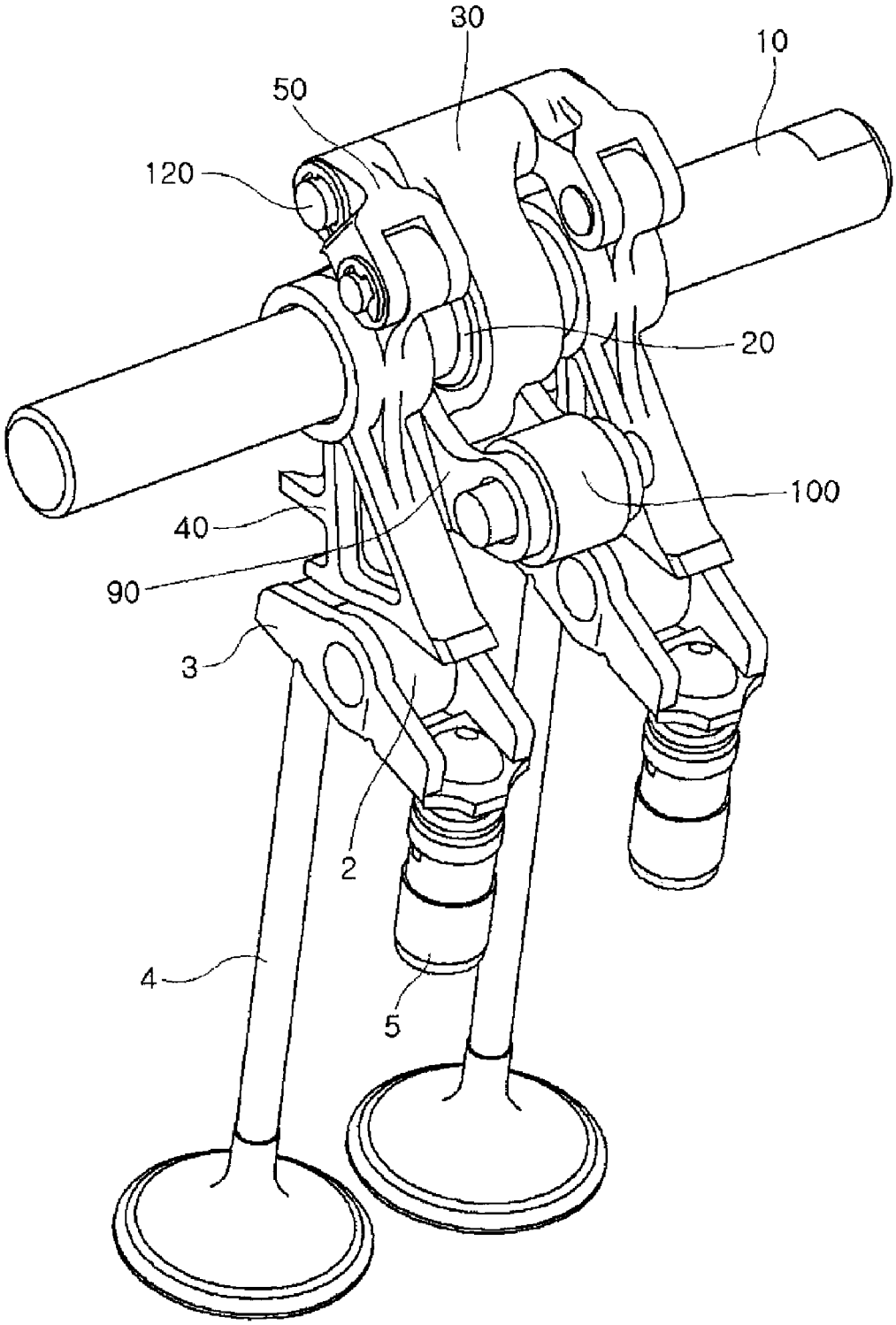
FIG. 5 is a perspective view of a state in which a variable lever link and a connection shaft thereof are removed in FIG. 4.
Figure 6:
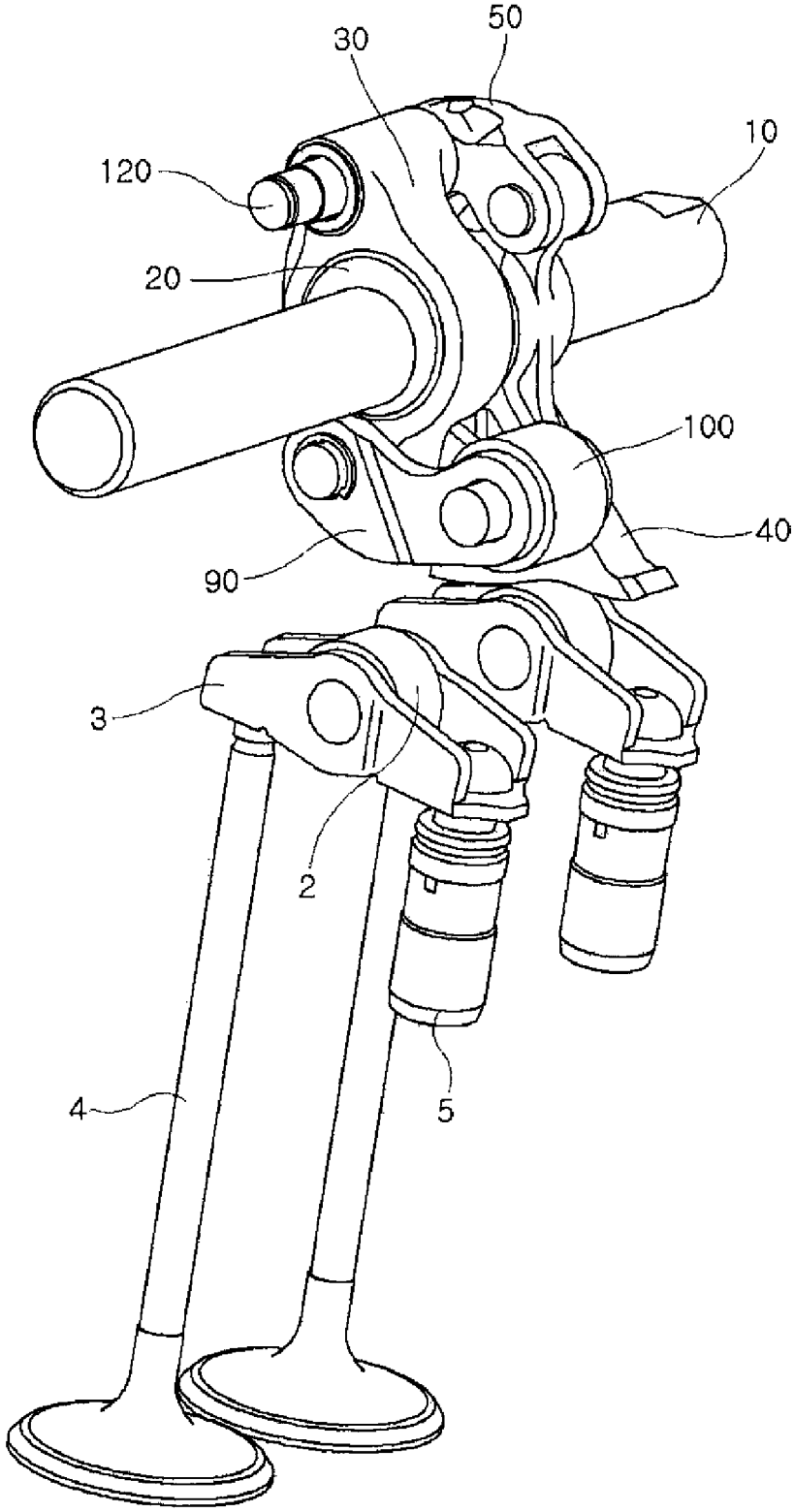
FIG. 6 is a perspective view of a state in which one oscillating cam and an oscillating cam link are removed in FIG. 5.
Figure 7:
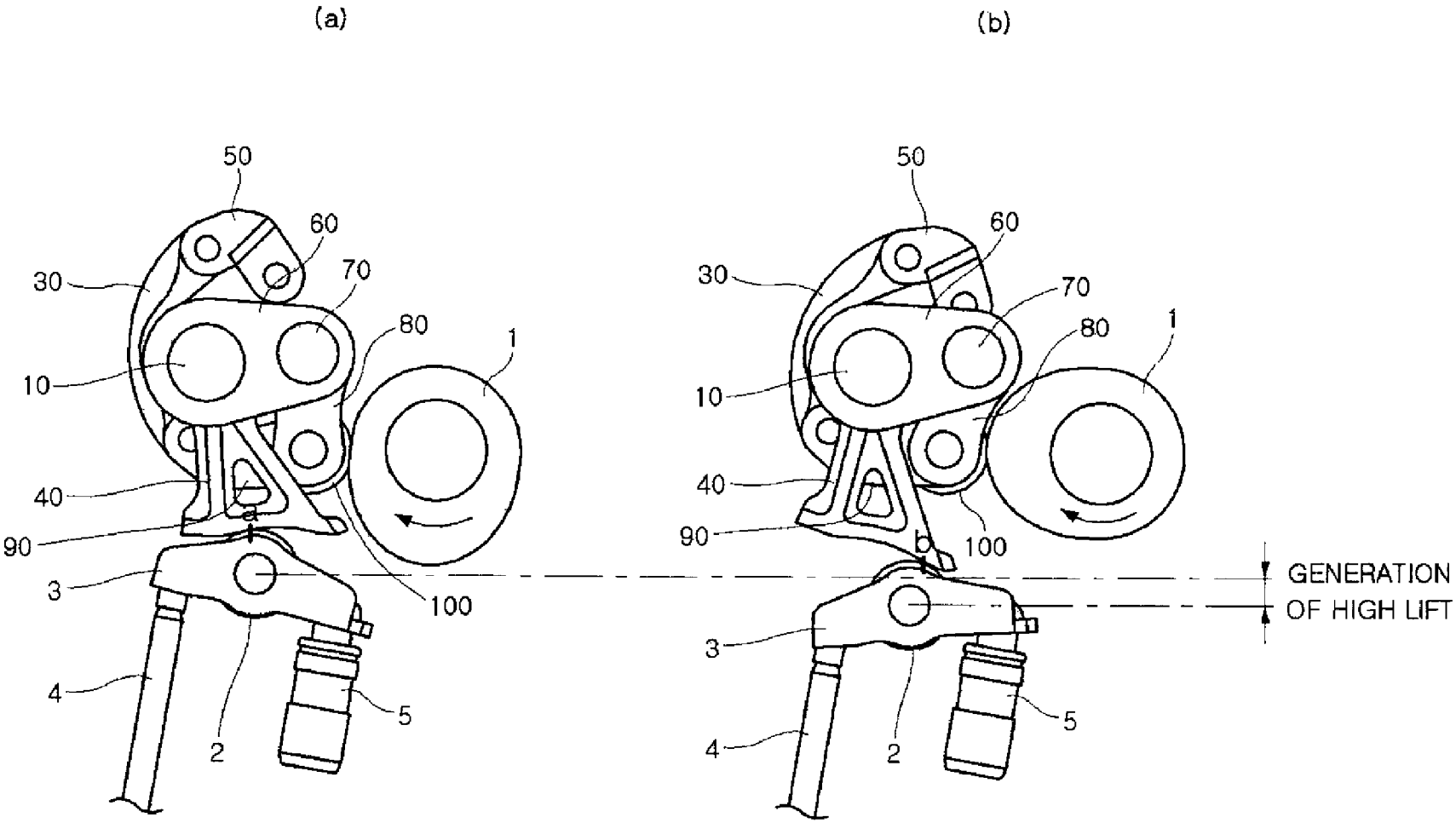
FIGS. 7A and 7B are operation state diagrams of a high lift state.
Figure 8:
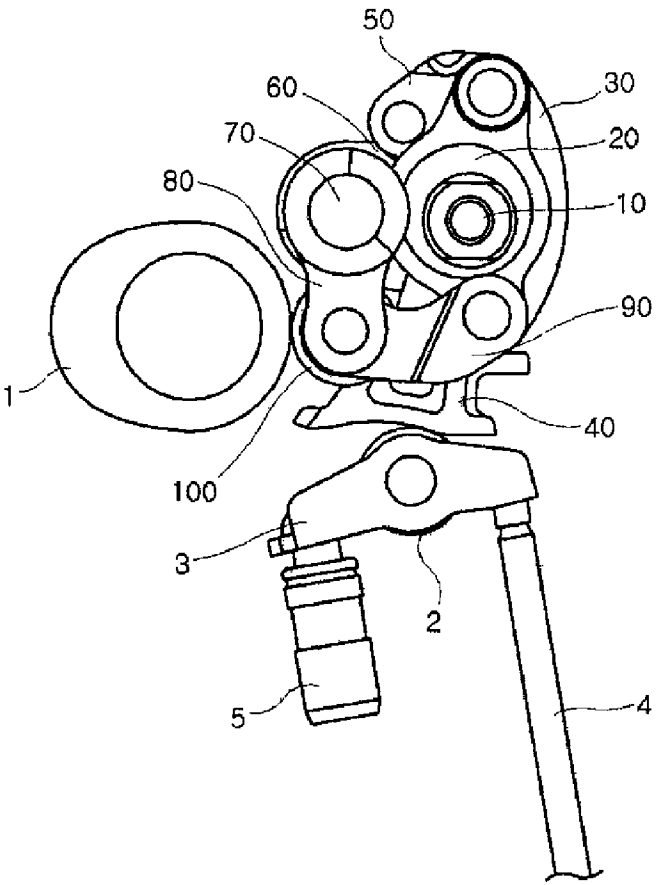
FIGS. 8A and 8B are diagrams illustrating an inner surface thereof.
Figure 8:
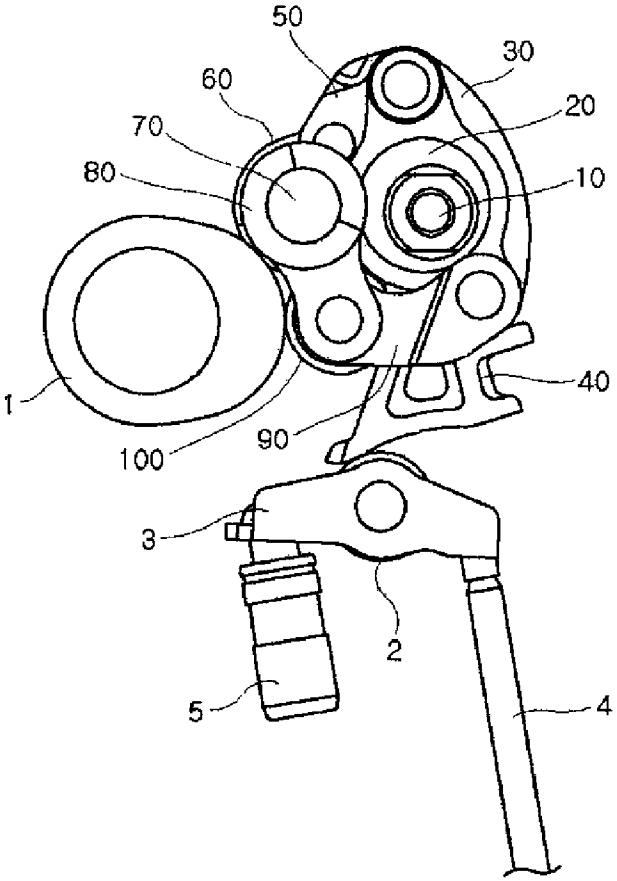
Figure 9:
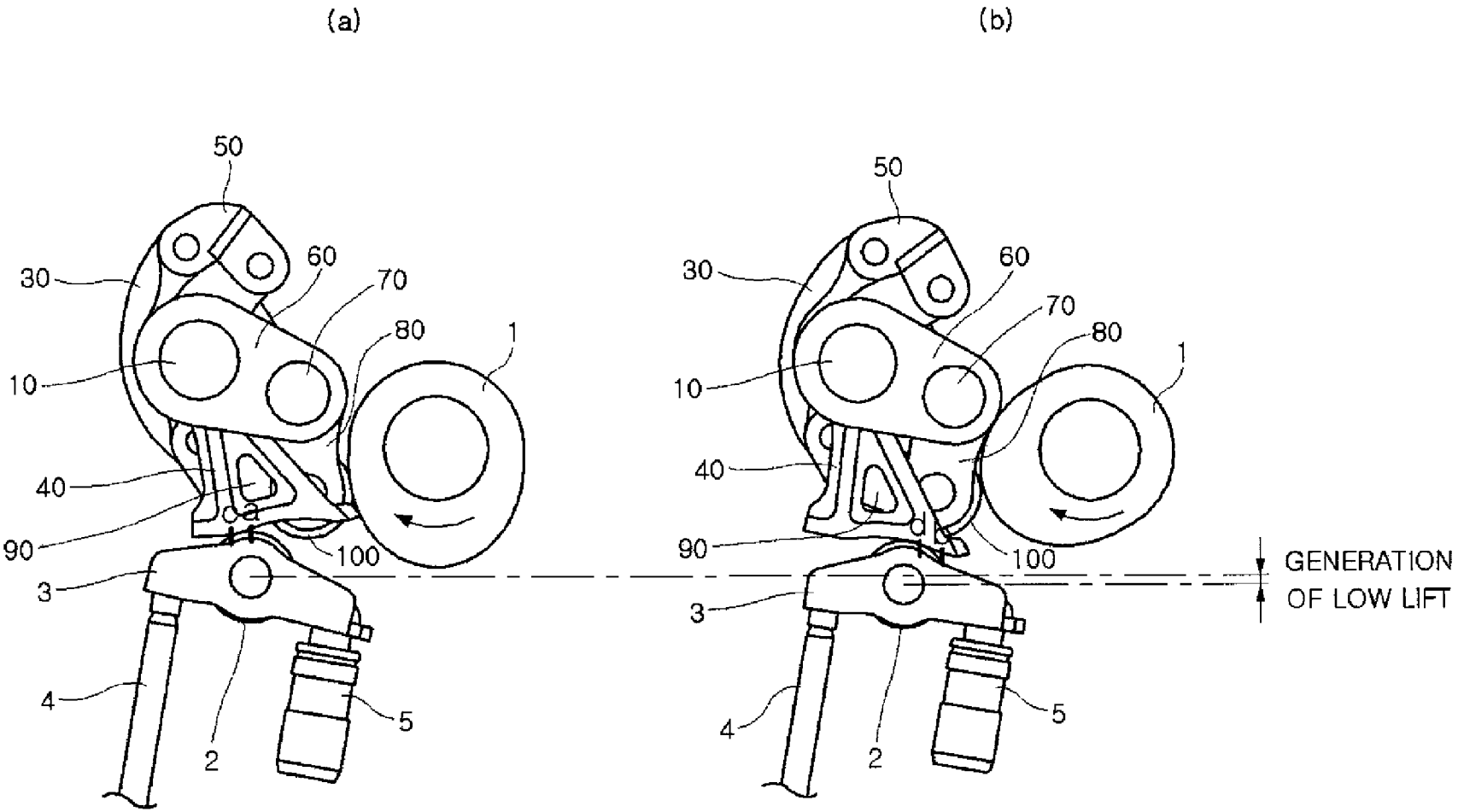
FIGS. 9A and 9B are operation state diagrams of a low lift state.
Figure 10:
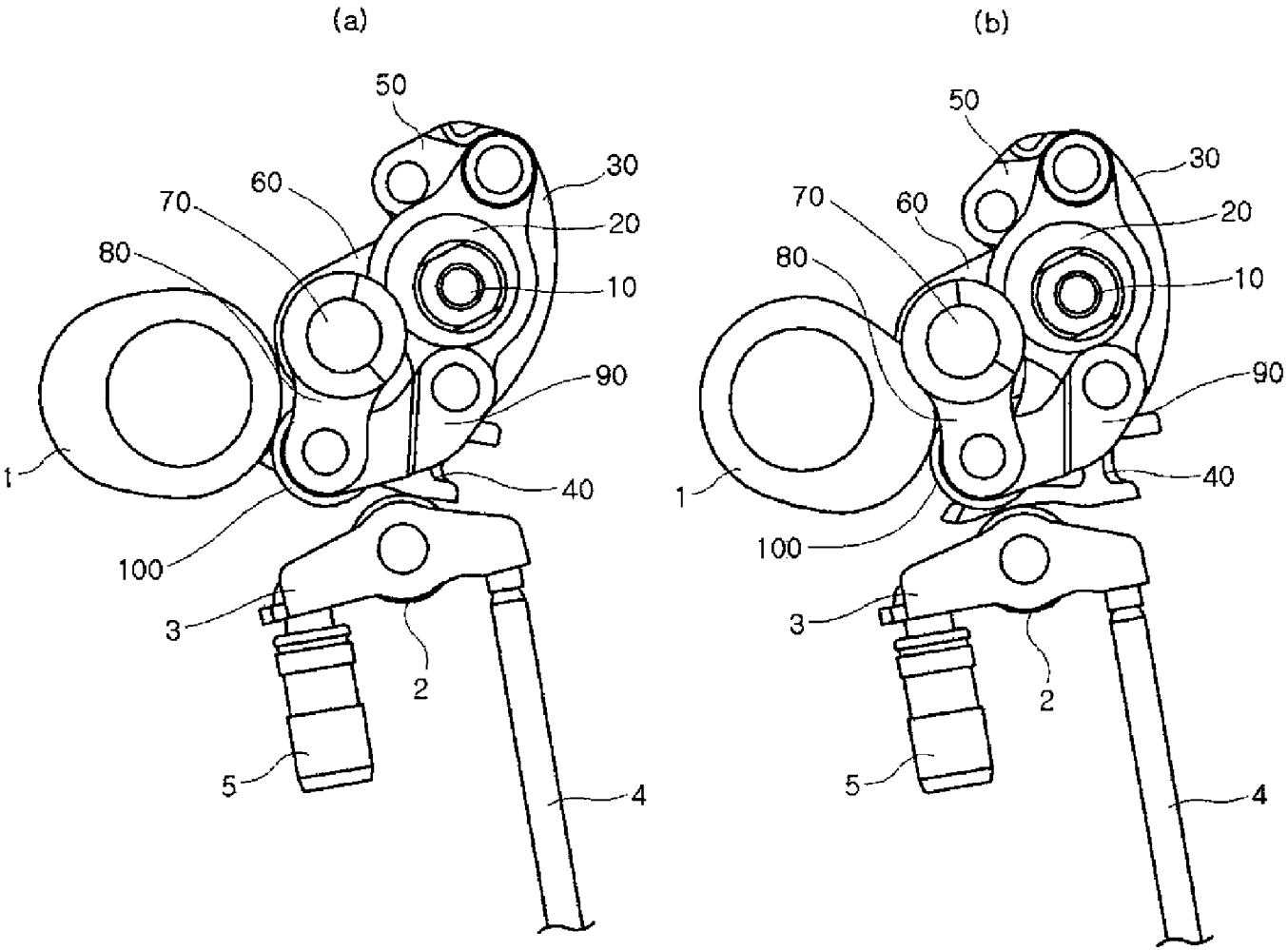
FIGS. 10A and 10B are diagrams illustrating an inner surface thereof.
Figure 11:
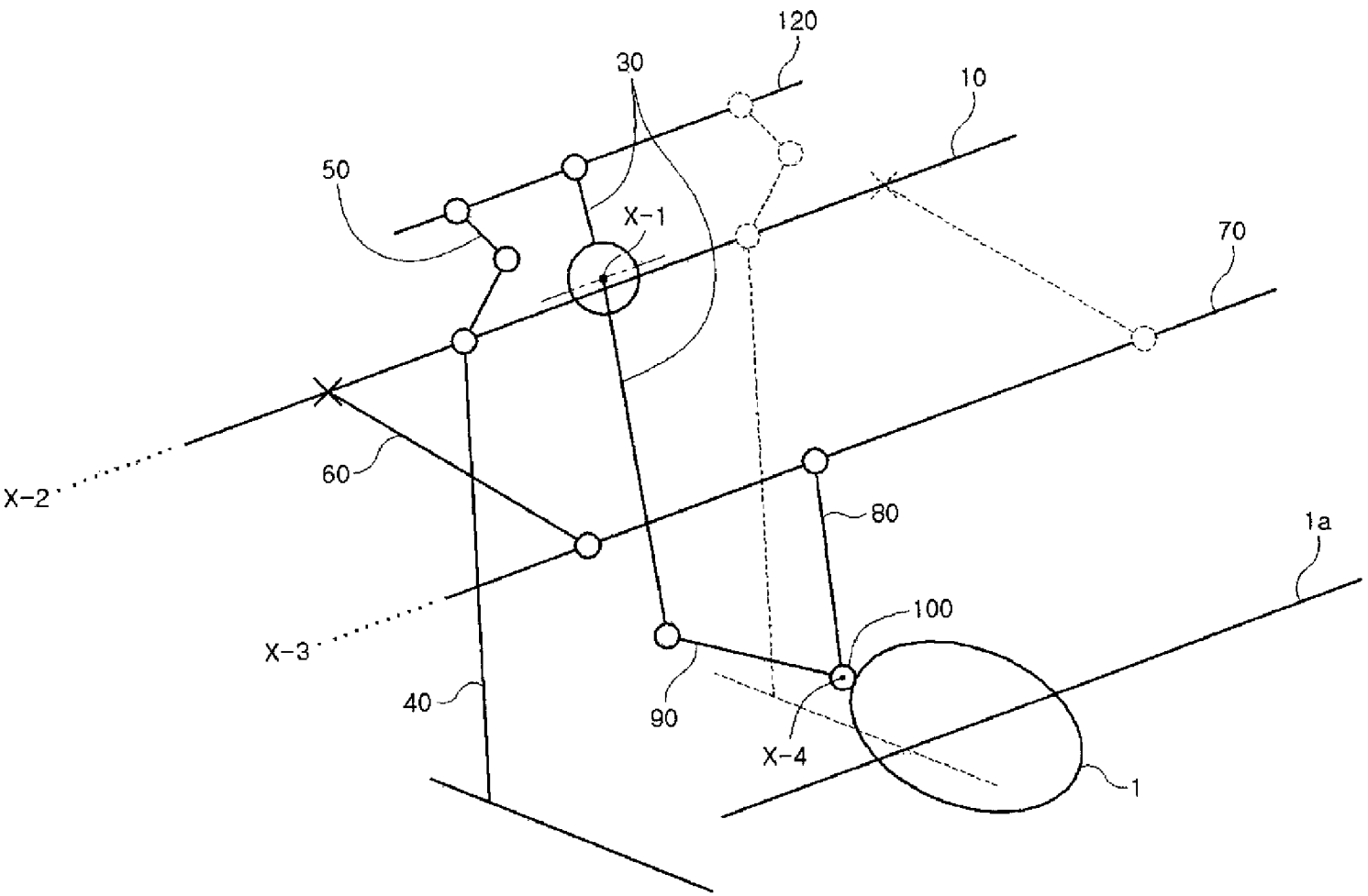
FIG. 11 is a schematic view illustrating connection relationships of constituent members according to an embodiment of the present invention.
Figure 12:
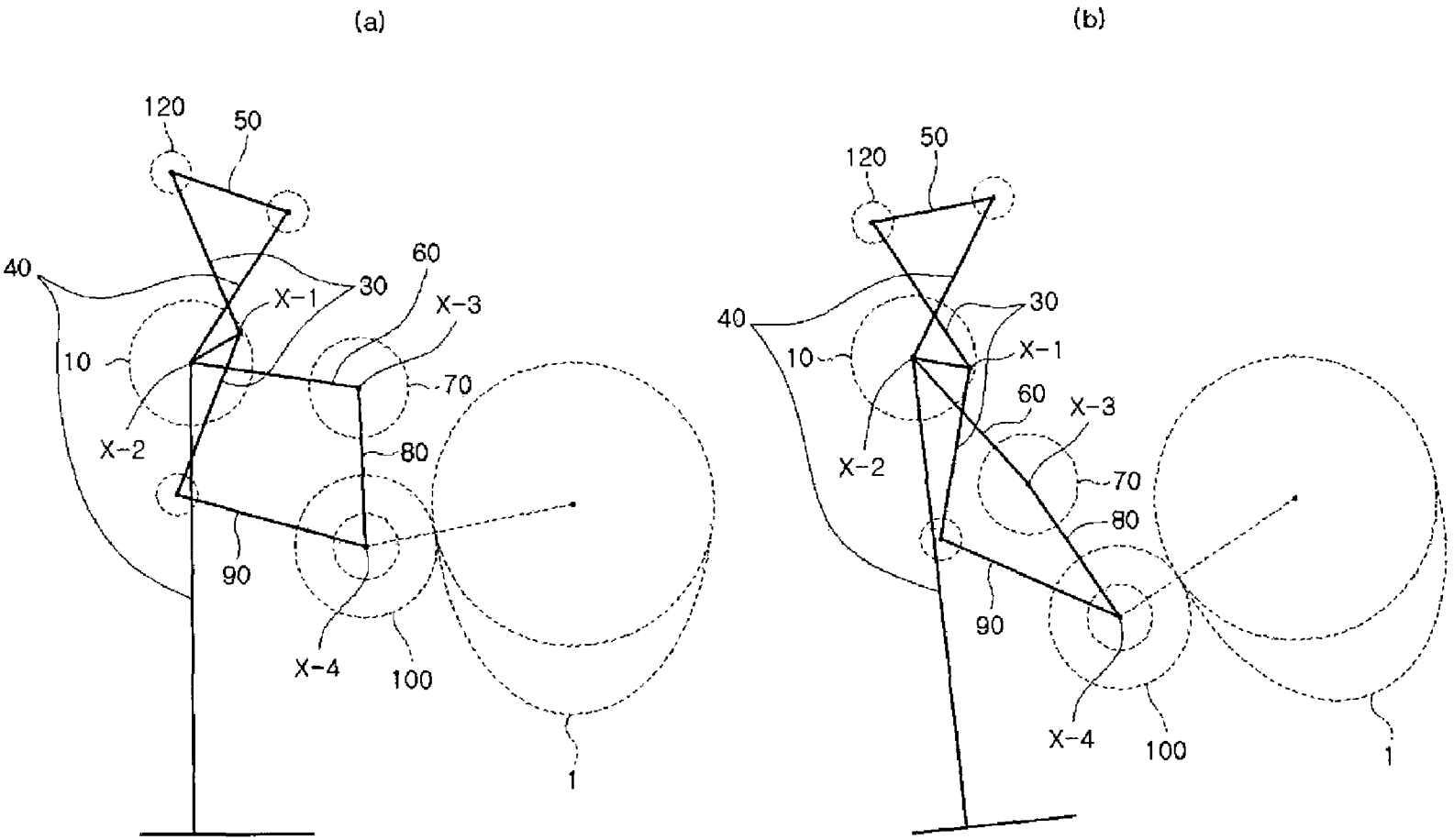
FIG. 12 is a schematic view illustrating a change of an installation state of each constituent member in high and low lift operations shown in FIGS. 7 and 9, respectively.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

FIGS. 1 to 12 illustrate an exemplary variously variable valve lift system for engines according to the present invention.

An eccentric cam shaft 10 is connected to a CVVL motor (hereinafter, referred to as 'motor') that can continuously variably control a rotation angle, such as a step motor to variably control the rotation angle and an eccentric cam 20 is integrally mounted in the middle thereof. An outer circumferential surface of eccentric cam 20 has a circular shape. Eccentric cam 20 is housed on an inner circumferential surface of a rocker arm 30. Of course, a hole forming the inner circumferential surface has the same size and shape as eccentric cam 20 (gap for rotating the eccentric cam is provided). For this, eccentric cam 20 is fitted and joined onto eccentric cam shaft 10 and rocker arm 30 is rotatably installed on eccentric cam 20.

At this time, a shaft center X-1 of eccentric cam 20 and a shaft center X-2 of eccentric cam shaft 10 are separated from each other. That is, rocker arm 30 is installed to rotate around shaft center X-1 of eccentric cam 20, shaft center X-2 of eccentric cam shaft 10 is installed at a position eccentric to shaft center X-1 of eccentric cam 20 by a predetermined length, and an oscillating cam 40 is installed to rotate around shaft center X-2 of eccentric cam shaft 10 to receive a pressing force provided by rotation of a driving cam 1 and provide an operating force required to close and open intake and exhaust valves.

Hinge pin connectors for connecting hinge pins are formed at both ends of a body of rocker arm 30. In various embodiments, the hinge pin connectors at both ends of the body of rocker arm 30 erect to be positioned at upper and lower sides of eccentric cam shaft 10, respectively. In eccentric cam shaft 10, oscillating cam 40 is rotatably mounted on the side of rocker arm 30.

Oscillating cam 40 includes a circular mounting portion with a hole which eccentric cam shaft 10 penetrates and a valve operating unit that is formed in a substantially triangle shape below the mounting portion and of which the bottom is in contact with a swing arm roller 2 of a swing arm 3. A cam profile for operating high lift and low lift is formed on the bottom of the valve operating unit.

Further, a rear surface (a direction opposite to driving cam 1) of the valve operating unit is supported by a return spring 110. More specifically, return spring 110 elastically supports oscillating cam 40 in an installation direction of driving cam 1 to maintain a constant contact state between an oscillating roller 100 and driving cam 1 (see FIG. 2, the return spring of the oscillating cam is shown in only FIG. 2 and not shown in the rest figures).

The hinge pin connector for connecting the hinge pin projects upward on an upper end of the mounting portion of oscillating cam 40. The hinge pin connector and one hinge pin connector of rocker arm 30 are connected to a '□' shaped oscillating cam link 50 in an upper part of eccentric cam shaft 10. That is, oscillating cam link 50 connects one end of rocker arm 30 and one end of oscillating cam 40 with each other. More specifically, both ends of oscillating cam link 50 are rotatably connected to the hinge pin connectors of rocker arm 30 and oscillating cam 40, respectively, by using the hinge pins. In particular, one end of rocker arm 30 and one end of oscillating cam link 50 are axially connected to each other via a connection shaft 120. One end of rocker arm 30 and one end of oscillating cam link 50 are axially connected to each other at a position separated from each other in an axial direction on connection shaft 120.

Meanwhile, one end of a variable lever 60 is integrally mounted on the side of oscillating cam 40 in eccentric cam shaft 10. Therefore, when eccentric cam shaft 10 is rotated by the motor, eccentric cam 20 and variable lever 60 integrally rotate at the same time. The other end of variable lever 60, that is, a free end that is not mounted on eccentric cam shaft 10 is installed in a substantially horizontal direction, such that a variable lever link 80 is rotatably mounted via a variable lever link shaft 70.

More specifically, one end of variable lever 60 is installed at shaft center X-2 of eccentric cam shaft 10 as a fixation point, such that a variable rotation point X-3 for variably controlling a position of a contact point X-4 with driving cam 1 that is installed in a cam shaft 1*a* depending on a rotation angle of eccentric cam shaft 10 is formed at a free end of the other side of the variable lever. That is, the variable rotation point X-3 is formed at a rotation end of variable lever 60. The variable rotation point X-3 is formed on a shaft line of a variable lever link shaft 70 that axially connects the rotation end of variable lever 60 and a rotation point of a variable lever link 80 with each other. The contact point X-4 is established at a joining portion between the other end of an oscillating roller link 90 and a rotation end of variable lever link 80.

In addition, a 2-joint link device connects the other end of rocker arm 30 and the variable rotation point X-3 of variable lever 60 with each other at the contact point X-4. The 2-joint link device includes variable lever link 80 of which one end is hinge-joined to the variable rotation point X-3 of variable lever 60 and oscillating roller link 90 of which one end is hinge-joined to the other end of rocker arm 30.

That is, a lower end of variable lever link 80 and a lower hinge pin connector of rocker arm 30 are connected to each other by oscillating roller link 90. Further, both ends of oscillating roller link 90 and the lower hinge pin connector of rocker arm 30 and the lower end of variable lever link 80 are rotatably connected to each other, respectively, via the hinge pins.

Meanwhile, an oscillating roller 100 that contacts driving cam 1 and receives the operating force is provided at the end of oscillating roller link 90 connected with variable lever link 80. That is, oscillating roller 100 is installed to roll-contact driving cam 1 at the contact point X-4 in an idle state. An upper end of a stem of a valve 4 contacts one end of swing arm 3 and the other end is connected to a hydraulic lash adjuster 5.

A continuously variable valve lift system for engines according to various embodiments of the present invention includes rocker arm 30 that is installed to rotate around shaft center X-1 of eccentric cam 20 and has upper and lower connectors, eccentric cam shaft 10 that is fixed to a position eccentric to shaft center X-1 of eccentric cam 20, oscillating cam 40 that is installed to rotate around shaft center X-2 of eccentric cam shaft 10 and provides the operating force to the intake and exhaust valves, oscillating cam link 50 of which one end is hinge-joined to the upper connector of oscillating cam 40 and the other end is axially connected with the upper connector of rocker arm 30 via connection shaft 120, variable lever 60 forming the variable rotation point X-3, which is installed at shaft center X-2 of eccentric cam shaft 10 as the fixation point and variably controls the position of the contact point X-4 with driving cam 1 installed in cam shaft 1*a* depending on the rotation angle of eccentric cam shaft 10, oscillating roller link 90 of which one end is hinge-joined to the lower connector of rocker arm 30, and variable lever link 80 of which one end is hinge-joined to the variable rotation point X-3 of variable lever 60 and the other end is hinge-joined to the other end of oscillating roller link 90 and is mounted with oscillating roller 100 that roll-contacts driving cam 1 to form the contact point X-4.

The above-configured system operates as follows. FIGS. 7A and 7B are operation state diagrams of a high lift state, FIGS. 8A and 8B are diagrams illustrating an inner surface thereof, FIGS. 9A and 9B are operation state diagrams of a low lift state, and FIGS. 10A and 10B are diagrams illustrating an inner surface thereof.

As shown in FIG. 7A, in a high lift state, variable lever 60 and oscillating roller link 90 maintain a substantially horizontal state and variable lever link 80 for connecting them maintains a substantially vertical state, and oscillating roller 100 provided at the end of oscillating roller link 90 is positioned at the same height as the center of driving cam 1.

In the state of (a), which is a state before the operating force is applied to oscillating roller 100 by driving cam 1, oscillating cam 40 is at a high lift operation start position (a: a middle position on an ascending inclined plane in a groove having a gentle inclination which is formed on the bottom of the oscillating cam) and when oscillating roller 100 is pushed by a cam nose while driving cam 1 rotates, oscillating roller link 90 pushes the lower end of rocker arm 30. Therefore, rocker arm 30 rotates in a clockwise direction around shaft center X-1 of eccentric cam 20, such that oscillating cam link 50 pushes the upper end of oscillating cam 40 and thus, oscillating cam 40 presses swing arm roller 2 while rotating in the clockwise direction around shaft center X-2 of eccentric cam shaft 10, such that swing arm 3 presses and opens the valves (see FIG. 12A).

At this time, since oscillating roller 100 is positioned at a center height of driving cam 1 and oscillating roller link 90 is disposed in the horizontal state, a movement amount of oscillating roller link 90 by driving cam 1 is large and thus a rotation amount of oscillating cam 40 by rocker arm 30 and oscillating cam link 50 is large, such that until oscillating cam 40 reaches an end portion b of the bottom while rotating, oscillating cam 40 presses swing arm roller 2, thereby generating high lift as shown in FIG. 7B.

Switching the high lift operation state into the low lift operation state by operating the motor is performed as follows.

As shown in FIG. 9A, when variable lever 60 rotates in the clockwise direction together with eccentric cam shaft 10, oscillating roller 100 descends together with variable lever link 80. Therefore, oscillating roller link 90 is pulled downward of driving cam 1 in the inclination state, rocker arm 30 rotates oscillating cam 40 in a counterclockwise direction by pulling the upper end of oscillating cam 40 via oscillating cam link 50 while rotating in the counterclockwise direction. That is, when variable lever 60 rotates in the clockwise direction by rotation of eccentric cam shaft 10, the rotation point X-3 of variable lever 60 descends in comparison with the high lift operation state. At this time, an installation state of rocker arm 30 is also changed by being interlocked with a positional change of shaft center X-1 of eccentric cam 20 with respect to shaft center X-2 of eccentric cam shaft 10. That is, when rocker arm 30 rotates in the counterclockwise direction around shaft center X-1, the lower end of rocker arm 30 pushes oscillating roller link 90, such that the position of the contact point X-4 between variable lever link 80 and oscillating roller link 90 is closer to driving cam 1 with descending in comparison with the high lift operation state (see FIG. 12B).

Accordingly, oscillating cam 40 moves to a low lift operation start position (c: a start position of the ascending inclined plane in the groove having the gentle inclination which is formed on the bottom of the oscillating cam) and this movement angle is a lost motion angle.

In the low lift operation state, since oscillating roller 100 descends below the center of driving cam 1 and oscillating roller link 90 is inclined, a horizontal pushed length of oscillating roller link 90 by driving cam 1 is not large.

Therefore, when rocker arm 30 is pushed by oscillating roller link 90, the rotation amount is not large, such that a clockwise rotation amount of oscillating cam 40 via oscillating cam link 50 is not large too. Further, since oscillating cam 40 reciprocally rotates within a narrow range reaching a middle point d of a descending inclined plane in the groove having the gentle inclination where swing arm roller 2 that contacts the bottom of oscillating cam 40 is formed on the bottom, a pressed length of swing arm roller 2 by oscillating cam 40 is reduced and thus a pressed length of valve 4 by swing arm 3 is also reduced, thereby reducing lift of valve 4.

In addition, in the low lift operation state, since oscillating roller 100 descends and moves in a direction opposite to the rotation direction of driving cam 1, an advancing state in which a valve opening time by driving cam 1 is advanced is implemented.

Contrary to this, like the high lift operation state, when an advancing lever 60 rotates in the counterclockwise direction to move oscillating roller 100 in the rotation direction of driving cam 1, a late state in which the valve opening time by driving cam 1 becomes late is implemented.

Figure 13:
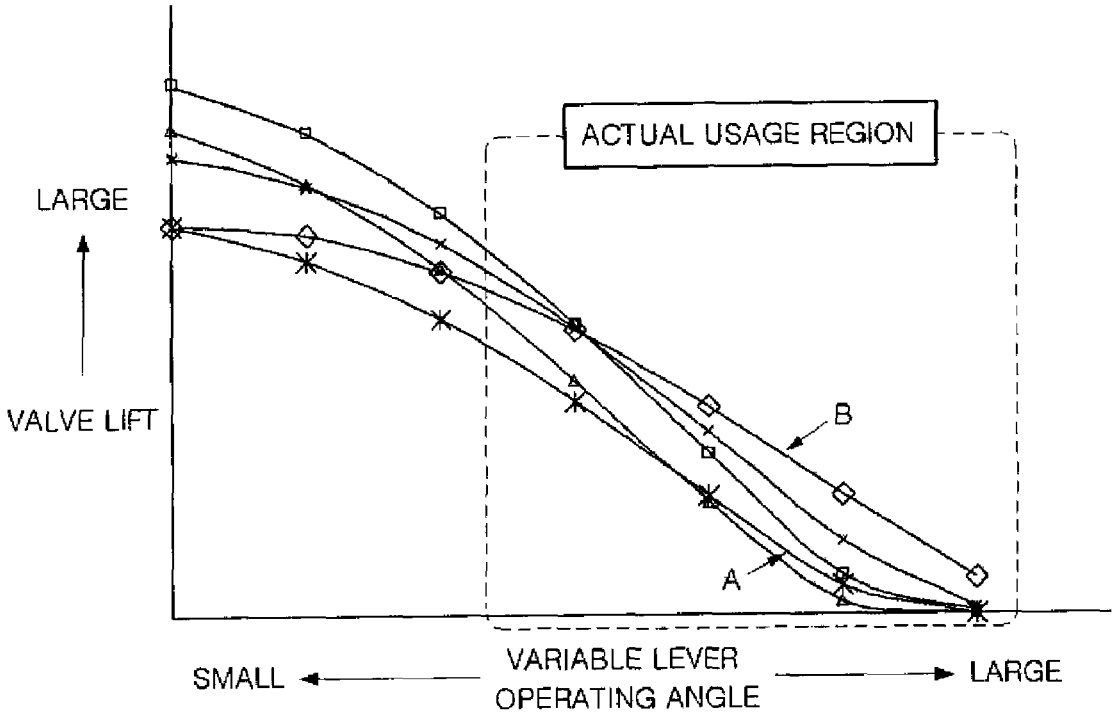
FIG. 13 is a graph illustrating a variable lever operating angle-valve lift characteristic curve depending on an eccentric cam.

FIG. 13 is a graph illustrating valve lift depending on a variable lever operating angle when eccentric cams having various eccentric directions and eccentric amounts are adopted.

As shown in the graph, various variable valve control characteristic curves can be acquired by controlling the direction and eccentric amount of the eccentric cam. In particular, in various embodiments of the present invention, the variable valve control characteristic curve has linearity like (B) in comparison with a case (A) in which the eccentric cam is fixed. Accordingly, a design and a manufacturing ability can be improved and a valve lift control performance can be improved.

Figure 14:
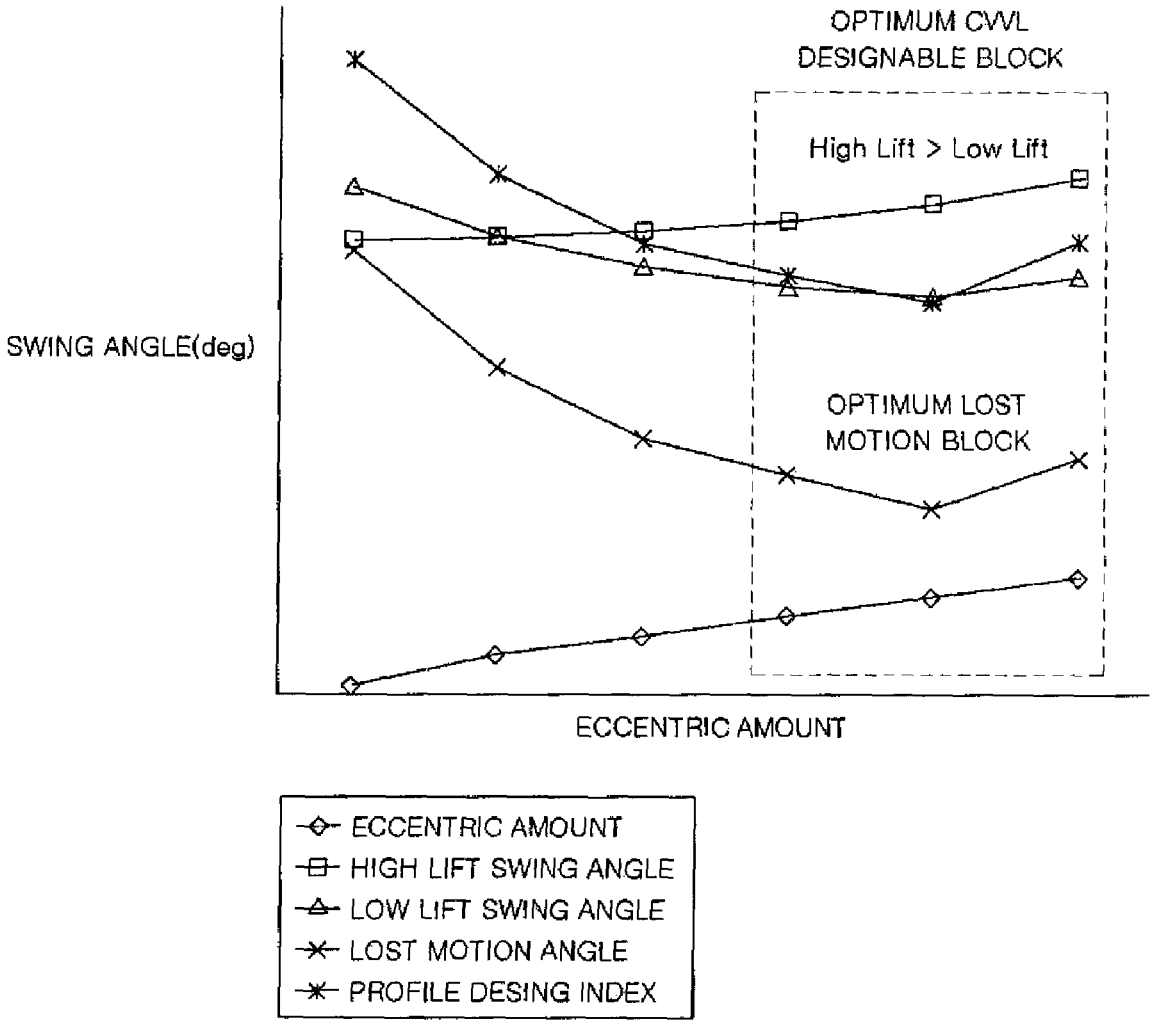
FIG. 14 is a graph illustrating an eccentricity amount of an eccentric cam-a swing angle of an oscillating cam.
Figure 15:
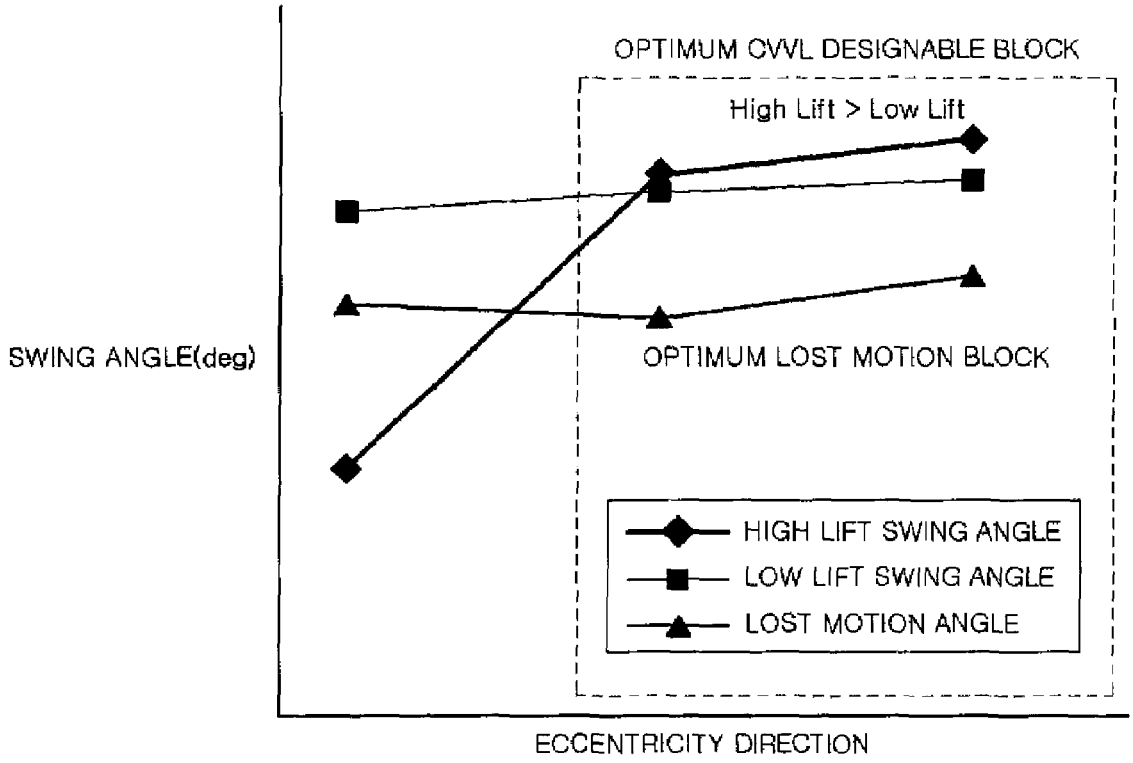
FIG. 15 is a graph illustrating an eccentricity direction of an eccentric cam-a swing angle of an oscillating cam.

Further, according to various embodiments of the present invention, as shown in FIGS. 14 and 15, a design region in which a high lift swing angle is lager than a low lift swing angle depending on the eccentric amount and eccentric direction of eccentric cam 20 and at the same time, an optimum lost motion angle is provided can be found. In FIG. 14, a block in which the high lift swing angle is larger than the low lift swing angle is provided in a range in which the lost motion angle has an optimum value depending on the eccentric amount of the eccentric cam. In FIG. 15, a block in which the high lift swing angle is larger than the low lift swing angle is provided in a range in which the lost motion angle has the optimum value depending on the eccentric direction of the eccentric cam.

Figure 16:
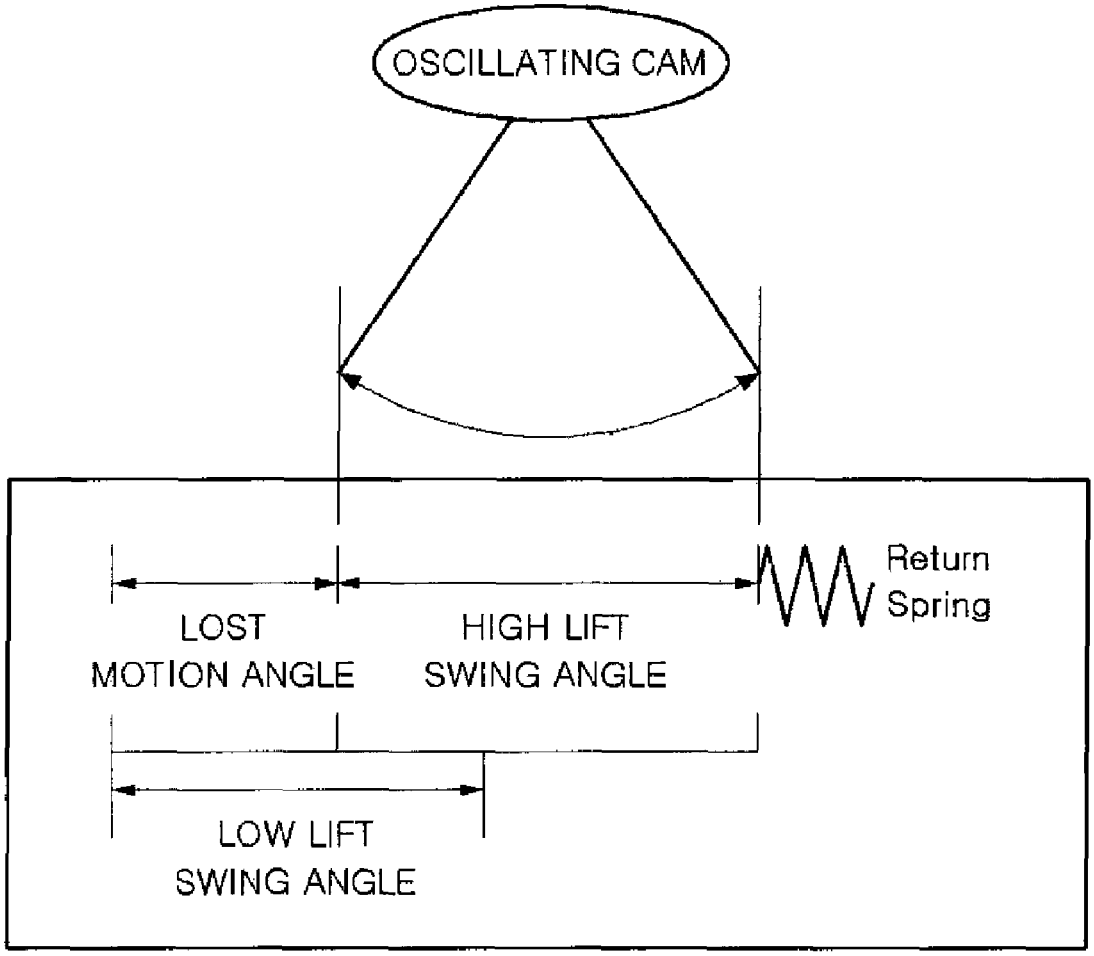
FIG. 16 is a pattern diagram illustrating a relationship among a high lift swing angle, a low lift swing angle, and a lost motion angle.

That is, as shown in FIG. 16, a state in which a high lift swing angle of oscillating cam 40 is larger than a low lift swing angle of oscillating cam 40 and the lost motion angle is smaller than the low lift swing angle can be implemented by adopting eccentric cam 20. The return spring of oscillating cam 40 is installed to suit the high lift swing angle. As a result, when the low lift swing angle is lager than the high lift swing angle, a reaction force of the return spring strongly acts in the low lift operation state to increase a fiction, thereby deteriorating fuel efficiency.

However, like the above-described embodiments of the present invention, when the high lift swing angle can be larger than the low lift swing angle, the reaction force of the return spring does not increase in the low lift operation state, such that it is possible to prevent the fuel efficiency from being deteriorated due to the increase of the fiction.

Meanwhile, when the lost motion angle is larger than the low lift swing angle, the CVVL cannot be implemented (when the lost motion angle is larger than the low lift angle, a low lift swing of the oscillating cam is started in the air). In various embodiments of the present invention, since an optimum range in which the lost motion angle is smaller than the low lift swing angle can be found, the CVVL is easily implemented to be adopted in an actual engine.

That is, in various embodiments of the present invention, it is possible to precisely control the valve lift operating angle (representing both the high lift swing angle and the low lift swing angel) and the lost motion angle by adjusting the eccentric amount and eccentric direction of the eccentric cam as described above.

Further, since oscillating roller 100 can move in a direction opposite to the rotation direction of driving cam 1 by variable lever 60 and variable lever link 80, an advancing function can be securely implement in the low lift operation state.

That is, in various embodiments of the present invention in which eccentric cam 20 and advancing lever 60 interlock with each other, it is possible to maximize an advancing effect by precisely controlling the valve lift operating angle and the lost motion angle. Therefore, a CVVL effect is improved.

Figure 17:
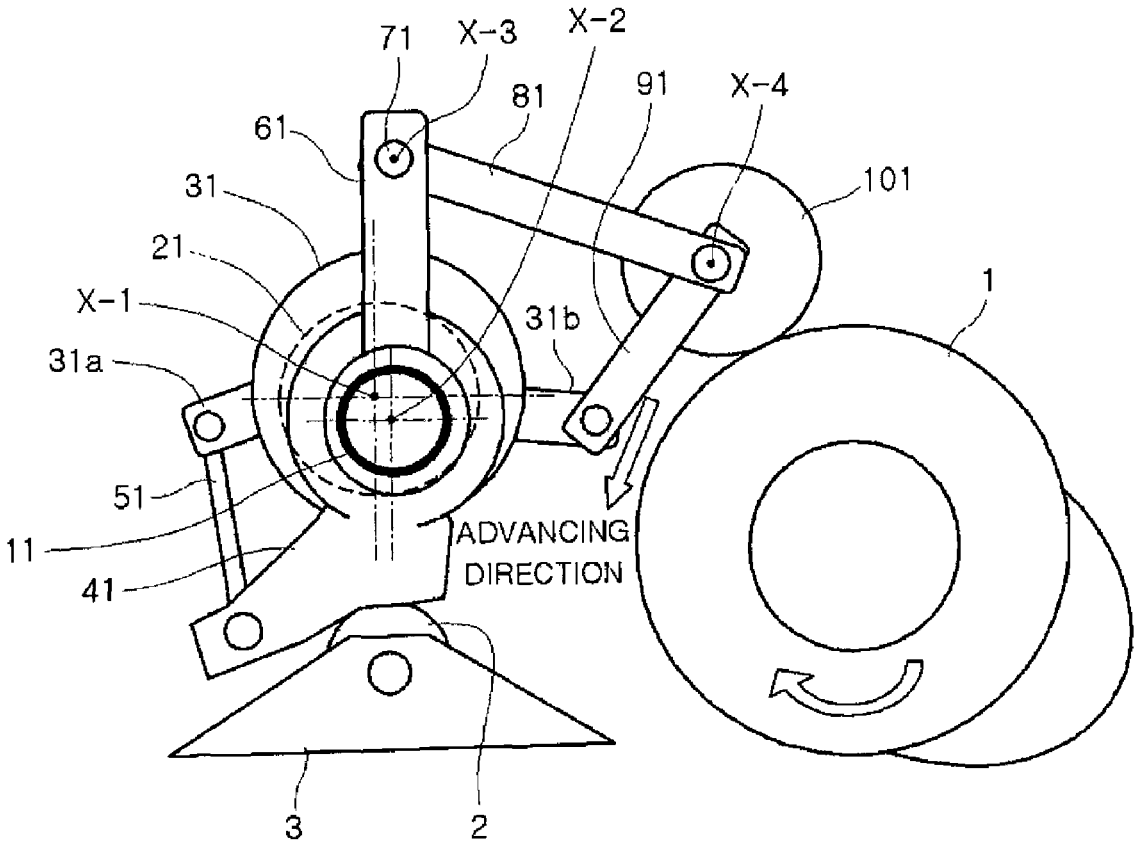
FIGS. 17 and 18 are diagrams illustrating a high lift state according to another embodiment of the present invention.

FIG. 17 illustrates other embodiments of the present invention. An eccentric cam 21 is integrally mounted on an eccentric cam shaft 11, hinge pin connectors 31*a* and 31*b* project at both sides of a body of a rocker arm 31 that is rotatably mounted to house eccentric cam 21 on an inner circumferential surface thereof, and hinge pin connectors 31*a* and 31*b* are disposed at left and right directions. That is, the hinge pin connectors 31*a* and 31*b* form left and right connectors at both sides of the body of rocker arm 31. Rocker arm 31 is installed to rotate around a shaft center X-1 of eccentric cam 21. Eccentric cam shaft 11 is fixed to a position eccentric to shaft center X-1 of eccentric cam 21.

An oscillating cam 41 is rotatably installed in eccentric cam shaft 11. A projecting end portion pressing a swing arm roller 2 in a high lift operation is formed in a direction opposite to driving cam 1 and hinge pin connector 31*a* of rocker arm 31 formed in the direction opposite to driving cam 1 is connected with the projecting end portion via an oscillating cam link 51. That is, oscillating cam 41 is installed to rotate around a shaft center X-2 of eccentric cam shaft 11 to provide an operating force to intake and exhaust valves. Oscillating cam link 51 connects a left connector of rocker arm 31 and one end of oscillating cam 41 to each other.

Further, variable lever 61 is disposed in eccentric cam shaft 11 in a vertical direction, a variable lever link 81 is rotatably connected to variable lever 61 via a variable lever link shaft 71, and variable lever link 81 extends to an upper part of driving cam 1 and is connected to hinge pin connector 31*b* of rocker arm 31 at the side of driving cam 1 via an oscillating roller link 91. That is, variable lever 61 is installed at shaft center X-2 of eccentric cam shaft 11 as a fixation point, such that a variable rotation point X-3 for variably controlling a position of a contact point X-4 with driving cam 1 that is installed in a cam shaft la depending on a rotation angle of eccentric cam shaft 11 is formed in the variable lever.

An oscillating roller 101 is provided at an end of oscillating roller link 91 at the side of variable lever link 81 and oscillating roller 101 is in contact with the upper part of driving cam 1. That is, one end of oscillating roller link 91 is hinge-joined to a right connector of rocker arm 31. One end of variable lever link 81 is hinge-joined to the variable rotation point X-3 of variable lever 61 and the other end of variable lever link 81 is hinge-joined to the other end of oscillating roller link 91, such that oscillating roller 101 that rolling-contacts driving cam 1 is mounted to form the contact point X-4.

In various embodiments, swing arm roller 2 is in contact with a high lift operation start position on a lower surface of oscillating cam 41 under the above-mentioned array state.

When driving cam 1 rotates under the above-mentioned state, oscillating roller link 91 pulls hinge pin connector 31*b* at the side of driving cam 1 upwards while oscillating roller 101 ascends, such that rocker arm 31 rotates in a counterclockwise direction. Therefore, hinge pin connector 31*b* opposite to driving cam 1 rotates oscillating cam 41 via oscillating cam link 51, such that a high lift swing is performed.

When eccentric cam shaft 11 rotates in the counterclockwise direction by a motor under the above-mentioned state, oscillating roller 101 moves down in an indicated advancing direction. Therefore, rocker arm 31 rotates in a clockwise direction and thus oscillating cam link 51 pulls oscillating cam 41, which rotates in the clockwise direction. Accordingly, on the bottom of oscillating cam 41, a contact point of swing arm roller 2 moves from the high lift operation start position to driving cam 1 to reach a low lift operation start position.

Since oscillating roller 101 descends in comparison with a high lift operation state under the above-mentioned state, an ascending length of oscillating roller 101 decreases when driving cam 1 rotates, thereby decreasing a counterclockwise rotation amount of rocker arm 31 by oscillating roller link 91. Consequently, a swing angle of oscillating cam 41 is reduced, such that a low lift operation is performed. That is, a high lift swing angle may be larger than a low lift swing angle.

A continuously variable valve lift system for engines according to other embodiments of the present invention includes rocker arm 31 that is installed to rotate around shaft center X-1 of eccentric cam 21 and has upper and lower connectors, eccentric cam shaft 11 that is fixed to a position eccentric to shaft center X-1 of eccentric cam 21, oscillating cam 41 that is installed to rotate around shaft center X-2 of eccentric cam shaft 11 and provides the operating force to the intake and exhaust valves, oscillating cam link 51 that connects the left connector of rocker arm 31 and one end of oscillating cam 41 to each other, variable lever 61 forming the variable rotation point X-3, which is installed at shaft center X-2 of eccentric cam shaft 11 as the fixation point and variably controls the position of the contact point X-4 with driving cam 1 installed in cam shaft 1*a* depending on the rotation angle of eccentric cam shaft 11, oscillating roller link 91 of which one end is hinge-joined to the right connector of rocker arm 31, and variable lever link 81 of which one end is hinge-joined to the variable rotation point X-3 of variable lever 61 and the other end is hinge-joined to the other end of oscillating roller link 91 and is mounted with oscillating roller 101 that roll-contacts driving cam 1 to form the contact point X-4.

Figure 18:
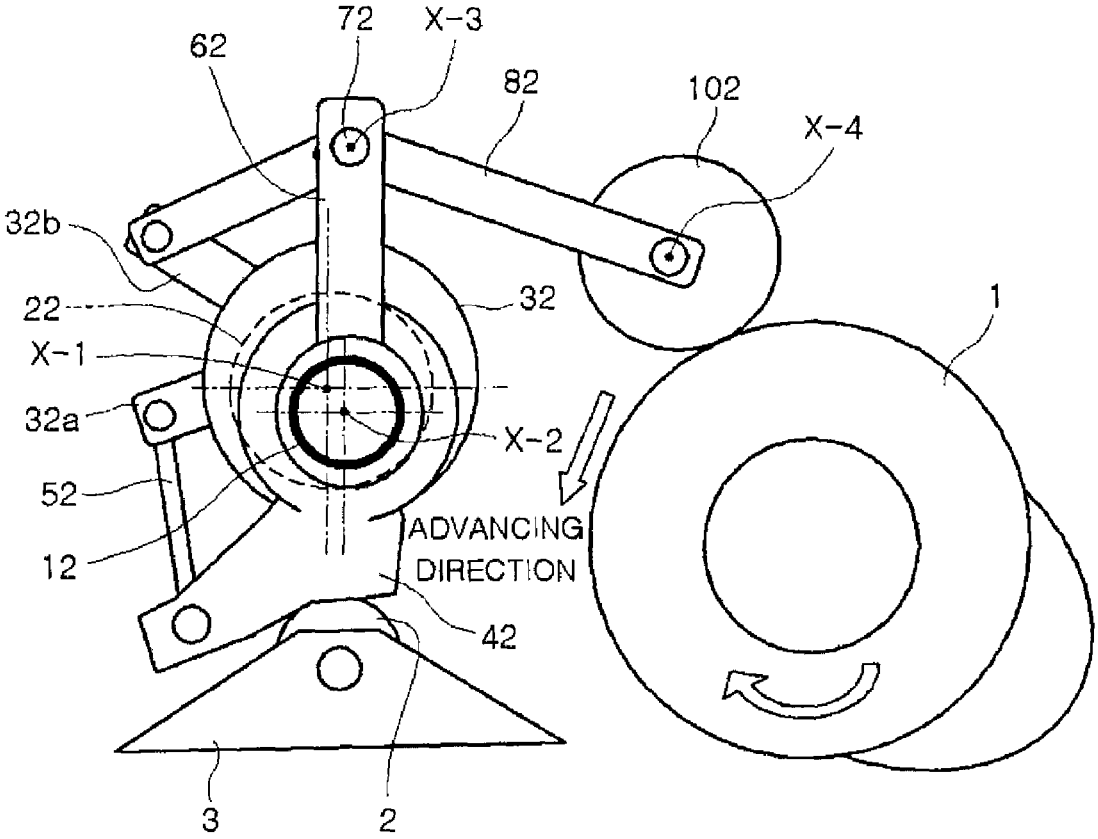

Meanwhile, FIG. 18 illustrates yet other embodiments of the present invention. An eccentric cam 22 is integrally mounted in an eccentric cam shaft 12 and a rocker arm 32 is rotatably mounted to house eccentric cam 22 on an inner circumferential surface thereof. Two hinge pin connectors 32*a* and 32*b* are formed at a side of rocker arm 32 opposite to driving cam 1 at a predetermined angle. An upper hinge pin connector 32*b* is longer than a lower hinge pin connector 32*a*. That is, rocker arm 32 is installed to rotate around a shaft center X-1 of eccentric cam 22 and has upper and lower connectors at one side thereof, such that the upper and lower connectors correspond to the hinge pin connectors 32*a* and 32*b*.

An oscillating cam 42 is rotatably mounted in eccentric cam shaft 12. A projection end portion that presses a swing arm roller 2 in a high lift operation state is formed in a direction opposite to driving cam 1, such that oscillating cam 42 is connected to a lower hinge pin connector 32*a* via an oscillating cam link 52. Of course, components connected by a hinge pin are inter-rotatable with each other. That is, eccentric cam shaft 12 is fixed to a position eccentric to a shaft center X-1 of eccentric cam 22. Oscillating cam 42 is installed to rotate around a shaft center X-2 of eccentric cam shaft 12 to provide an operating force to intake and exhaust valves. Oscillating cam link 52 connects a lower connector of rocker arm 32 and one end of oscillating cam 42 to each other.

A variable lever 62 is integrally and rotatably installed in eccentric cam shaft 12 with being erected in a vertical direction. A variable lever link 82 that is bent at an obtuse angle is rotatably mounted on the end portion of variable lever 62 via a variable lever link shaft 72. A hinge rotation point by variable lever link shaft 72 becomes a bent portion. That is, variable lever 62 is installed at shaft center X-2 of eccentric cam shaft 12 as a fixation point, such that a variable rotation point X-3 for variably controlling a position of a contact point X-4 with driving cam 1 that is installed in a cam shaft 1*a* depending on a rotation angle of eccentric cam shaft 12 is formed in the variable lever 62.

A part of variable lever link 82 at the side of driving cam 1 is comparatively longer than an opposite part and extends to an upper part of driving cam 1. An oscillating roller 102 is rotatably mounted on an end of the part to be in contact with the upper part of driving cam 1.

In addition, the part of variable lever link 82 at the side opposite to driving cam 1 is comparatively shorter than the part with oscillating roller 102 and is rotatably connected to an upper hinge pin connector 32*b* of rocker arm 32 by the hinge pin. That is, one end of variable lever link 82 is hinge-joined to an upper connector of rocker arm 32 and the other end is mounted with oscillating roller 102 that rolling-contacts driving cam 1 to form the contact point X-4. Variable lever link 82 is hinge-joined to the variable rotation point X-3 of variable lever 62 between an upper connection point of rocker arm 32 and an installation point of oscillating roller 102.

In various embodiments, swing arm roller 2 is in contact with a high lift operation start position on a lower surface of oscillating cam 41 under the above-mentioned array state.

When driving cam 1 rotates (in a clockwise direction) under the above-mentioned state, oscillating roller 102 ascends to rotate the variable lever link 82 around variable lever link shaft 72 in a counterclockwise direction. Therefore, the opposite end of variable lever link 82 presses the upper hinge pin connector 32*b* to rotate rocker arm 32 in the same counterclockwise direction as the above-mentioned direction. As a result, the lower hinge pin connector 32*a* of rocker arm 32 pushes oscillating cam 42 through oscillating cam link 52 and rotates oscillating cam link 52 in the counterclockwise direction, such that a high lift operation is performed.

When variable lever 62 rotates in the counterclockwise direction at a predetermined angle (approximately eleven o'clock direction by rotating eccentric cam shaft 12) by using a motor under the above-mentioned state, oscillating roller 102 moves to a lower part of driving cam 1, such that an advancing state is implemented. At the same time, variable lever link 82 rotates in the clockwise direction by descending oscillating roller 102, such that upper hinge pin connector 32*b* is pulled to rotate rocker arm 32 in the same direction. Therefore, oscillating cam 42 is pulled by oscillating cam link 52 and rotates in the clockwise direction, such that a contact point of swing arm roller 2 moves from a high lift operation start position to a low lift operation start position on the bottom of oscillating cam 42.

Since an ascending length of oscillating roller 102 is small while driving cam 1 rotates in the state when oscillating roller 102 descends on the surface of driving cam 1 as described above, a rotation amount of rocker arm 32 is also decreased and thus a rotation amount of oscillating cam 42 by oscillating cam link 52 is also decreased. Consequently, a low lift swing angle is smaller than a high lift swing angle.

A continuously variable valve lift system for engines according to other embodiments of the present invention includes rocker arm 32 that is installed to rotate around shaft center X-1 of eccentric cam 22 and has upper and lower connectors, eccentric cam shaft 12 that is fixed to a position eccentric to shaft center X-1 of eccentric cam 22, oscillating cam 42 that is installed to rotate around shaft center X-2 of eccentric cam shaft 12 and provides the operating force to the intake and exhaust valves, oscillating cam link 52 that connects the lower connector of rocker arm 32 and one end of oscillating cam 42 to each other, variable lever 62 forming the variable rotation point X-3, which is installed at shaft center X-2 of eccentric cam shaft 12 as the fixation point and variably controls the position of the contact point X-4 with driving cam 1 installed in cam shaft 1*a* depending on the rotation angle of eccentric cam shaft 12, and variable lever link 82 of which one end is hinge-joined to the upper connector of rocker arm 32 and the other end is mounted with oscillating roller 102 that rolling-contacts driving cam 1 to form the contact point X-4 and is hinge-joined to the variable rotation point X-3 of variable lever 62 between the upper connection point of rocker arm 32 and an installation point of oscillating roller 102.

Hereinafter, a controlling method of a continuously variable valve lift system for engines according to various embodiments of the present invention will be described in detail.

Figure 19:
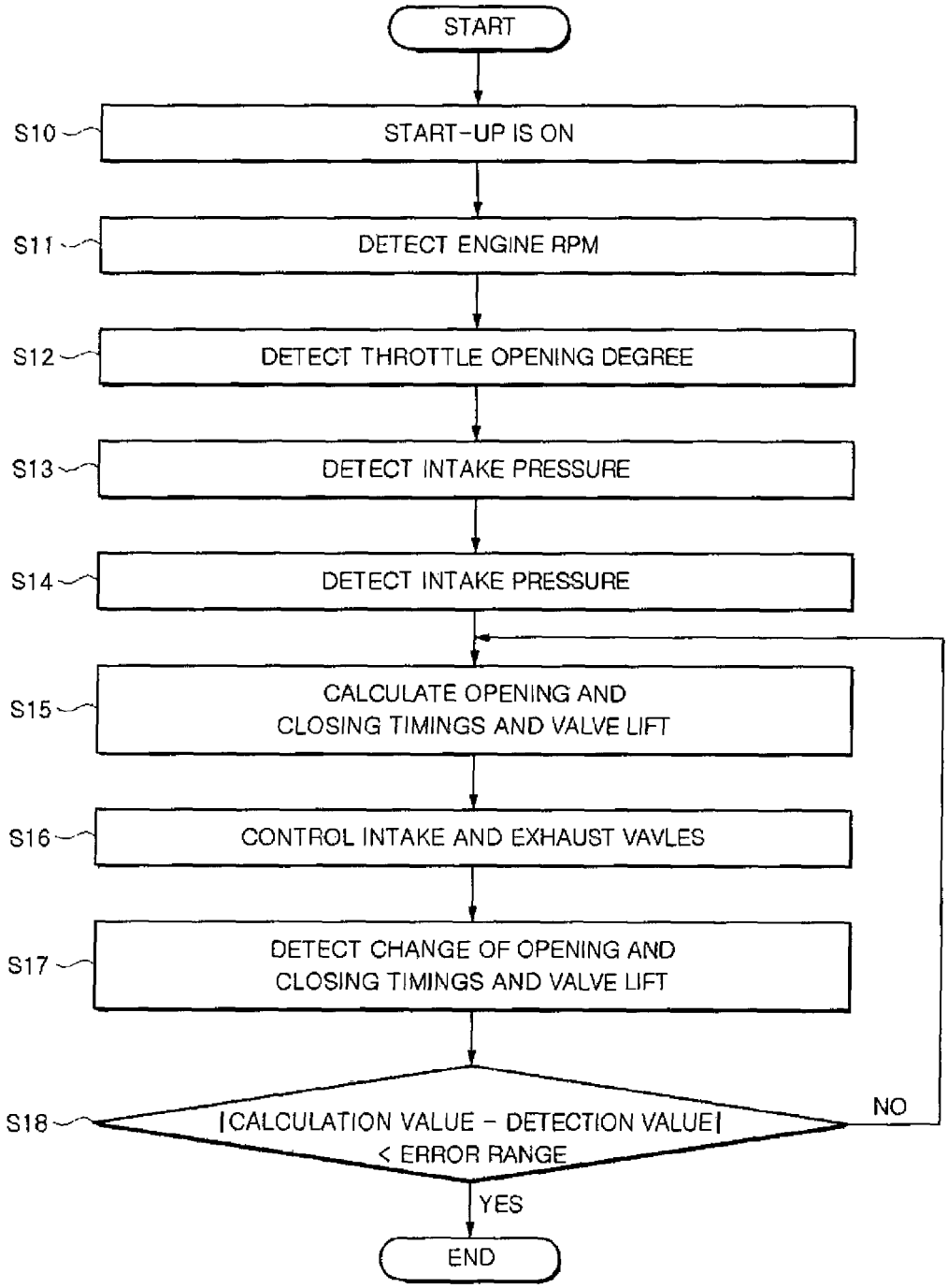
FIG. 19 is a flowchart illustrating a control logic according to an embodiment of the present invention.

As shown in FIG. 19, engine RPM, a throttle opening degree, and a change of an intake pressure when a start-up is on are detected (S10 to S13).

Subsequently, a current load condition of a vehicle that corresponds to the engine RPM, the throttle opening degree, and the intake pressure detected in the step is determined (S14).

Thereafter, an opening timing and valve lift of intake and exhaust valves that correspond to the determined load condition in the step are calculated (S15).

The opening and closing timings and valve lift of the intake and exhaust valves are controlled in response to the opening and closing timings and valve lift of the intake and exhaust valves, which are calculated in the step (S16). This is implemented by an operation signal outputted to a valve lift control driver (CVVL motor) in response to a control performed by an engine control unit (ECU).

The changes of the opening and closing timings and the valve lift of the intake and exhaust valves, which are performed in the step are detected (S17).

By comparing the calculation values of the opening and closing timings and the valve lift of the intake and exhaust valves, which are calculated in the step and the change values of the opening and closing timings and the valve lift of the intake and exhaust valves, which are detected in the step, if a difference therebetween is within a set error, the control is terminated and if the difference is deviated from the set error, the steps after the step of calculating the opening and closing timings and the valve lift of the intake and exhaust valves that correspond to the load condition are repetitively performed (S18).

Meanwhile, the step of determining the load condition is performed by reading the engine RPM, the throttle opening degree, and the change of the intake pressure while driving from map data in which the engine RPM, the throttle opening degree, and the change of the intake pressure are established through various tests and stored.

Figure 20:
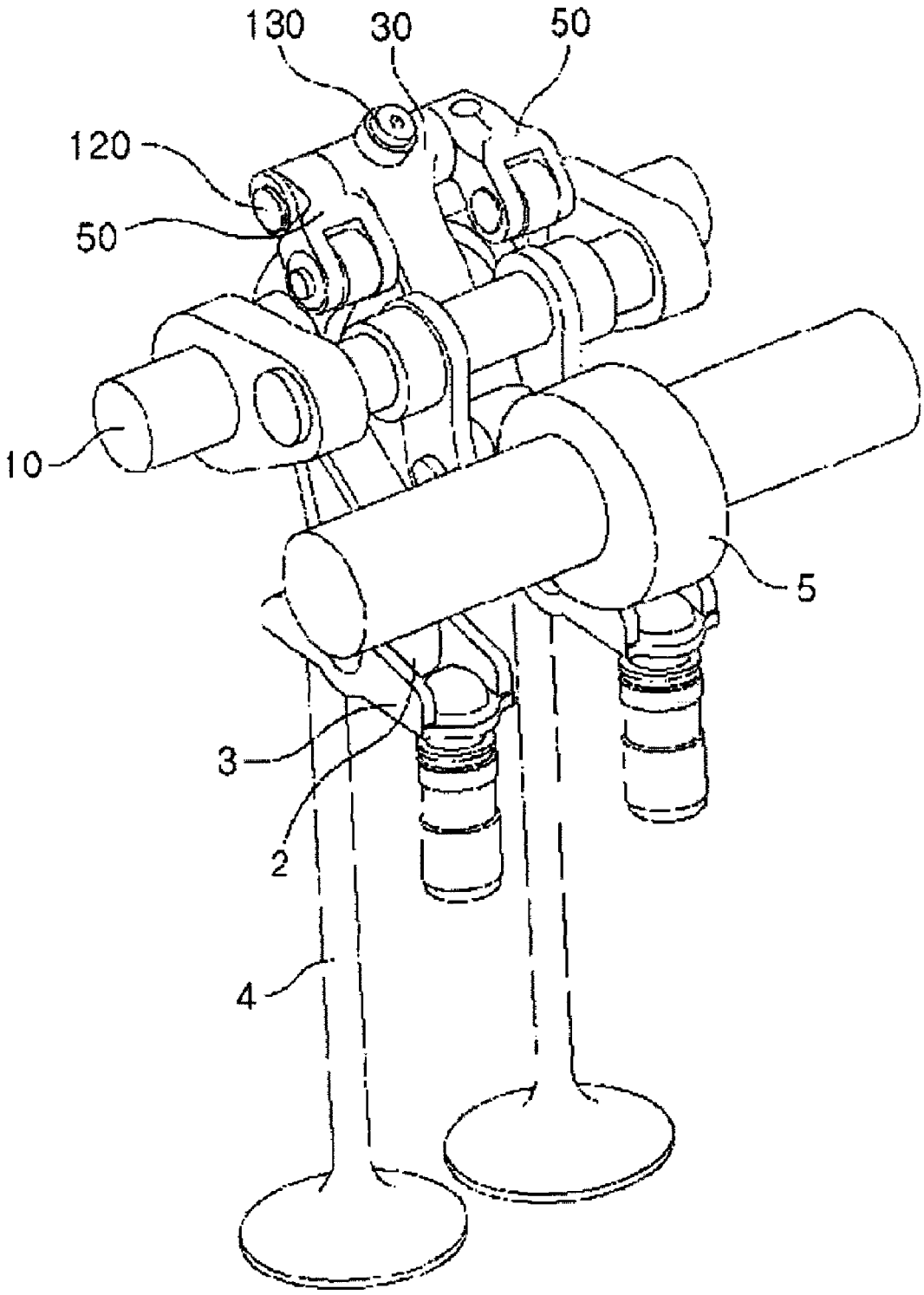
FIG. 20 is a perspective view of a continuously variable valve lift system according to another embodiment of the present invention.
Figure 21:
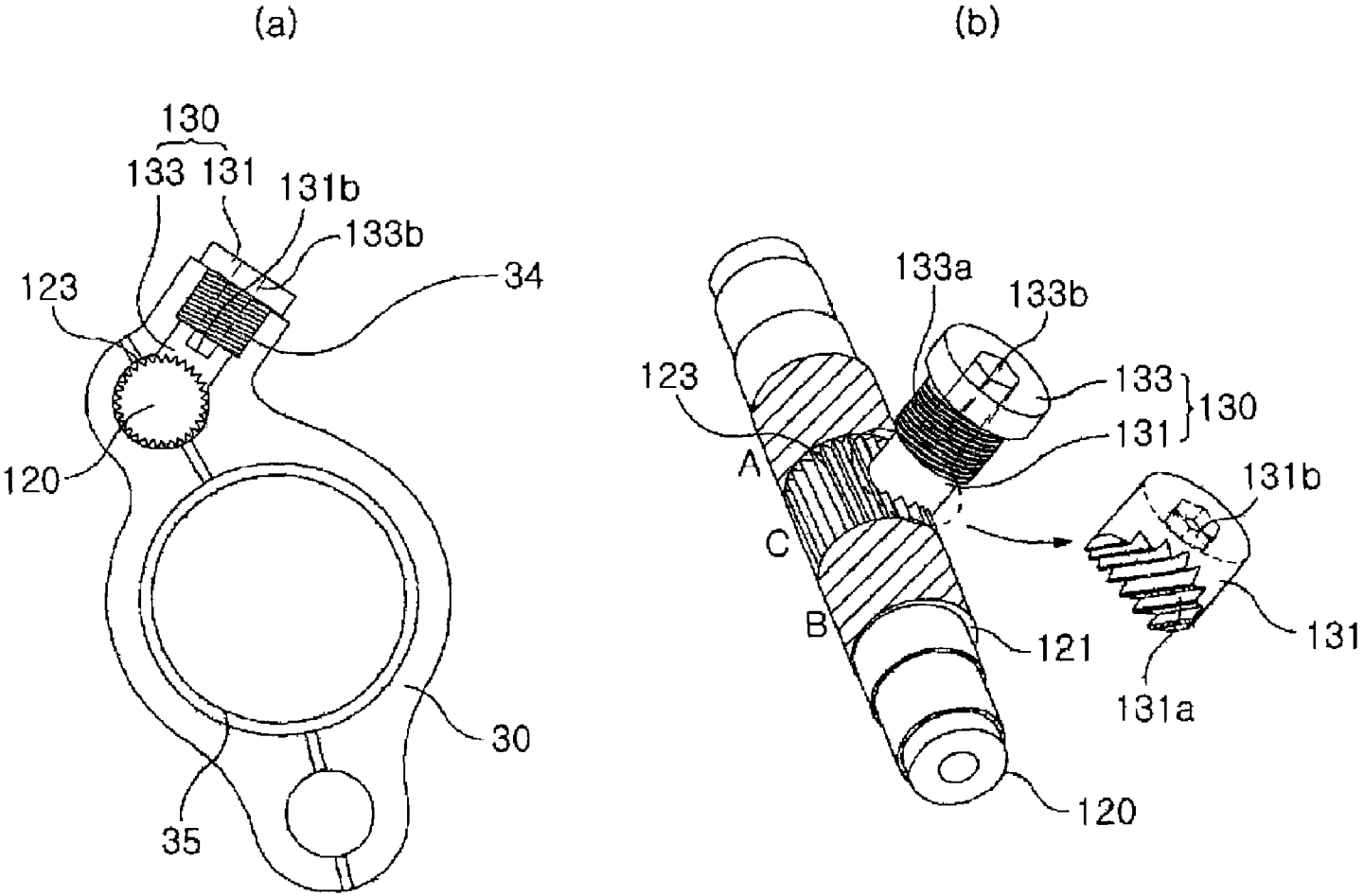
FIG. 21A is a cross-sectional view illustrating a cross-section of a rocker arm of FIG. 1
FIG. 21B is a perspective view illustrating a connection pin and a rotation preventing member.

A CVVL according to other embodiments which can conveniently perform a clearance adjusting operation of an oscillating cam link is shown in FIGS. 20 and 21. The same components as the above-mentioned CVVL refer to the same reference numerals. Therefore, a description thereof will be omitted and only different components will be described in detail.

As shown in FIGS. 20 and 21, the CVVL according to various embodiments of the present invention includes an adjusting unit that connects a rocker arm 30 and an oscillating cam link 50 with each other and is fixed after adjusting the clearance of oscillating cam link 50.

The adjusting unit includes a connection shaft 120 that connects rocker arm 30 and oscillating cam link 50 with each other and a rotation preventing member 130 that is installed on a mounting portion 34 provided in rocker arm 30 to prevent rotation of connection shaft 120.

Oscillating cam link 50 is constituted by a pair. Oscillating cam links 50 are joined to both ends of connection shaft 120, respectively. Rocker arm 30 is joined to the center of connection shaft 120 between oscillating cam links 50.

A pin cam 121 is provided on an outer circumferential surface of connection shaft 120 to be eccentric. A gear-shaped protrusion 123 is formed on an outer circumferential surface of pin cam 121 in a circumferential direction of connection shaft 120.

Protrusion 123 is formed at a middle portion (middle portion of the pin cam in a longitudinal direction of the connection shaft) of pin cam 121. Further, protrusion 123 may formed in a straight line or an oblique line in the longitudinal direction of connection shaft 120.

Pin cam 121 provided in connection shaft 120 to be eccentric adjusts the clearance of oscillating cam link 50 that are joined to both sides of connection shaft 120 at the time of rotating connection shaft 120.

That is, when the clearance is generated in oscillating cam link 50, a profile of a valve 4 is changed. For this reason, it is necessary to accurately adjust the clearance of oscillating cam link 50. Therefore, when connection shaft 120 provided with pin cam 121 rotates, a distance between the center of an eccentric cam shaft 10 and the center of pin cam 121 is increased and decreased. As a result, a distance between eccentric cam shaft 10 and oscillating cam link 50 is changed, such that it is possible to conveniently adjust the clearance of oscillating cam link 50.

As described above, after accurately adjusting the clearance of oscillating cam link 50 by rotating connection shaft 120, connection shaft 120 must be locked so as to prevent connection shaft 120 from being rotated. In various embodiments of the present invention, connection shaft 120 is prevented from being rotated by installing rotation preventing member 130 engaged and joined to protrusion 123 formed in pin cam 121 in mounting portion 34 provided in rocker arm 30.

That is, a protrusion engaging portion 131*a* that is engaged and joined to protrusion 123 is provided in rotation preventing member 130, such that when connection shaft 120 rotates to engage protrusion 123 and protrusion engaging portion 131*a* to each other, thereby preventing connection shaft 120 from being rotated. Therefore, an additional work for suppressing the rotation of connection shaft 120 is not required, such that the work can conveniently be performed.

Meanwhile, pin cam 121 can be largely divided into parts A, B, and C. Since a transmission force of oscillating cam link 50, which acts on connection shaft 120 primarily concentrates on the parts A and B of pin cam 121 and the force of oscillating cam link 50 does not almost concentrate on the part C that is positioned at the center, it is possible to prevent connection shaft 120 from being rotated even by applying a small clamping force to the part C.

That is, in the related art, since the transmission force transmitted to a swing arm concentrates on the end of the connection shaft, a large force is required to join a nut to the connection shaft, while in various embodiments of the present invention, since the force transmitted to oscillating cam link 50 is not almost applied to the part C of pin cam 121, the clamping force of rotation preventing member 130 is not particularly required.

Further, unlike the related art in which the nut is released by vibration, etc, such that a locking force of the connection shaft is not strong, since the transmission force of oscillating cam link 50 applied between connection shaft 120 and rotation preventing member 130 is not almost applied, a locking force between connection shaft 120 and rotation preventing member 130 is strong, such that it is possible to accurately adjust the clearance of oscillating cam link 50.

In addition, in various embodiments of the present invention, since rotation preventing member 130 is installed in mounting portion 34 that is formed in rocker arm 30, protrusion 123 of connection shaft 120 and protrusion engaging portion 131*a* of rotation preventing member 130 can be engaged with each other even in a narrow operation space.

Herein, rotation preventing member 130 includes a lock 131 having the protrusion engaging portion 131*a* formed on the bottom thereof and a lock adjuster 133 that is manufactured to be removable from and integrally joined to lock 131.

Any one of lock 131 and lock adjuster 133 is made of an iron material and the other is constituted by a magnet, such that lock 131 and lock adjuster 133 are integrally joined to each other by a magnetic force.

A male screw portion 133*a* is formed on an outer circumferential surface of lock adjuster 133. Male screw portion 133*a* is configured to be screw-joined to mounting portion 34 that is provided in rocker arm 30.

That is, an inner circumferential surface of mounting portion 34 provided in rocker arm 30 is formed of a female screw portion (not shown) that corresponds to male screw portion 133*a*.

Therefore, as shown in FIG. 21A, in the case when connection shaft must be rotated due to the clearance of oscillating cam link 50 in a state when rotation preventing member 130 is assembled to mounting portion 34 of rocker arm 30, the tolerance is adjusted by rotating connection shaft 120 after making rotation preventing member 130 be spaced from protrusion 123 of connection shaft 120 by a predetermined distance by rotating lock adjuster 133 in the counterclockwise direction.

When protrusion engaging portion 131*a* is engaged with protrusion 123 by rotating lock adjuster 133 in the clockwise direction after adjusting the clearance is completed, connection shaft 120 is prevented from being rotated.

Meanwhile, control holes 131*b* and 133*b* are formed at the centers of lock 131 and lock adjuster 133, respectively. When protrusion engaging portion 131*a* of lock 131 is not engaged with protrusion 123 of connection shaft 120 but is deviated from protrusion 123 of connection shaft 120, the position of lock 131 is adjusted by inserting a tool into control holes 131*b* and 133*b*, such that protrusion 123 and protrusion engaging portion 131*a* are accurately engaged with each other.

Protrusion engaging portion 131*a* may be formed in a straight line or an oblique line in the longitudinal direction of connection shaft 120 depending on the shape of protrusion 123.

Undescribed reference numeral 35 shown in FIG. 21 represents an eccentric cam installation portion that is formed at the center of rocker arm 30 in order to install eccentric cam 20. Eccentric cam installation portion 35 is formed in a shape to have a gap for rotation of eccentric cam 20.

Figure 22:
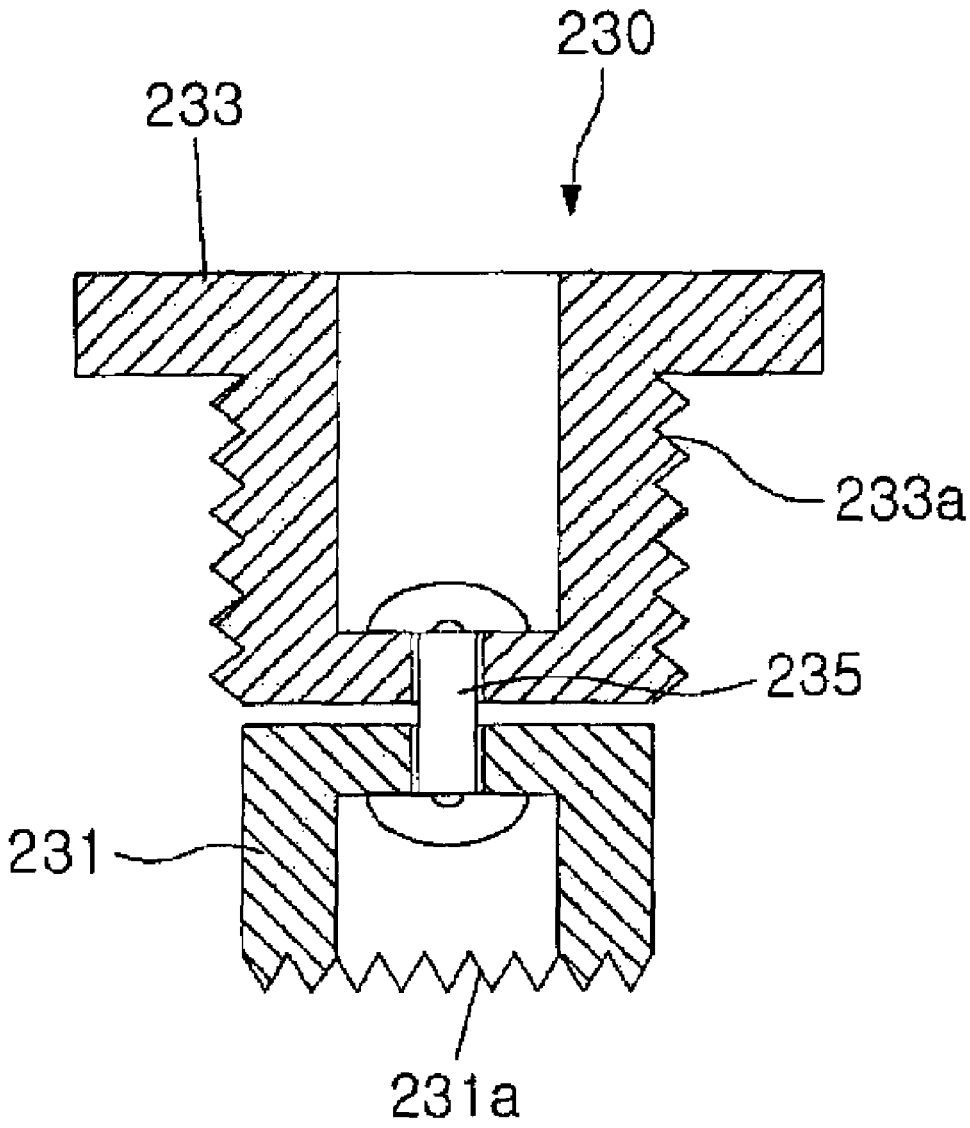
FIGS. 22 to 24 are diagrams for illustrating a rotation preventing member according to another embodiment.
Figure 23:
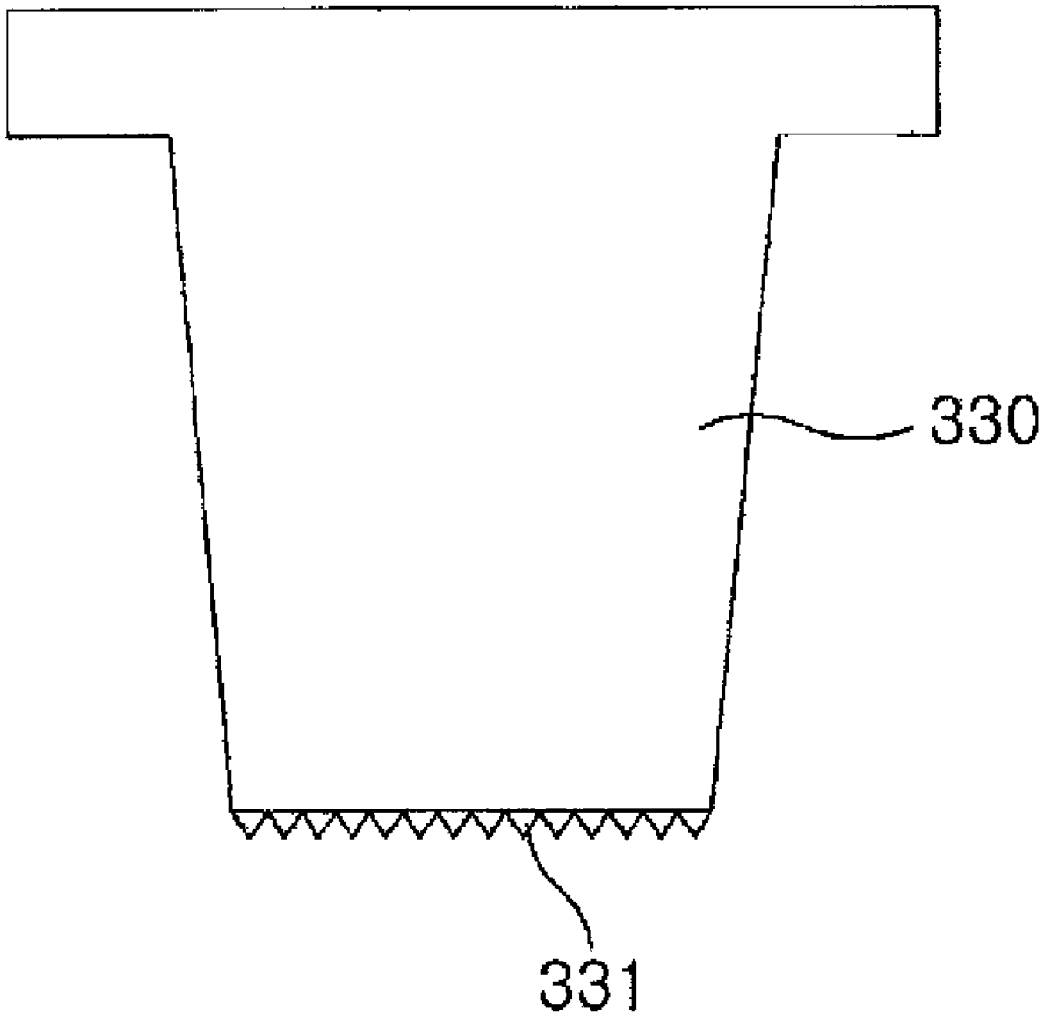
Figure 24:
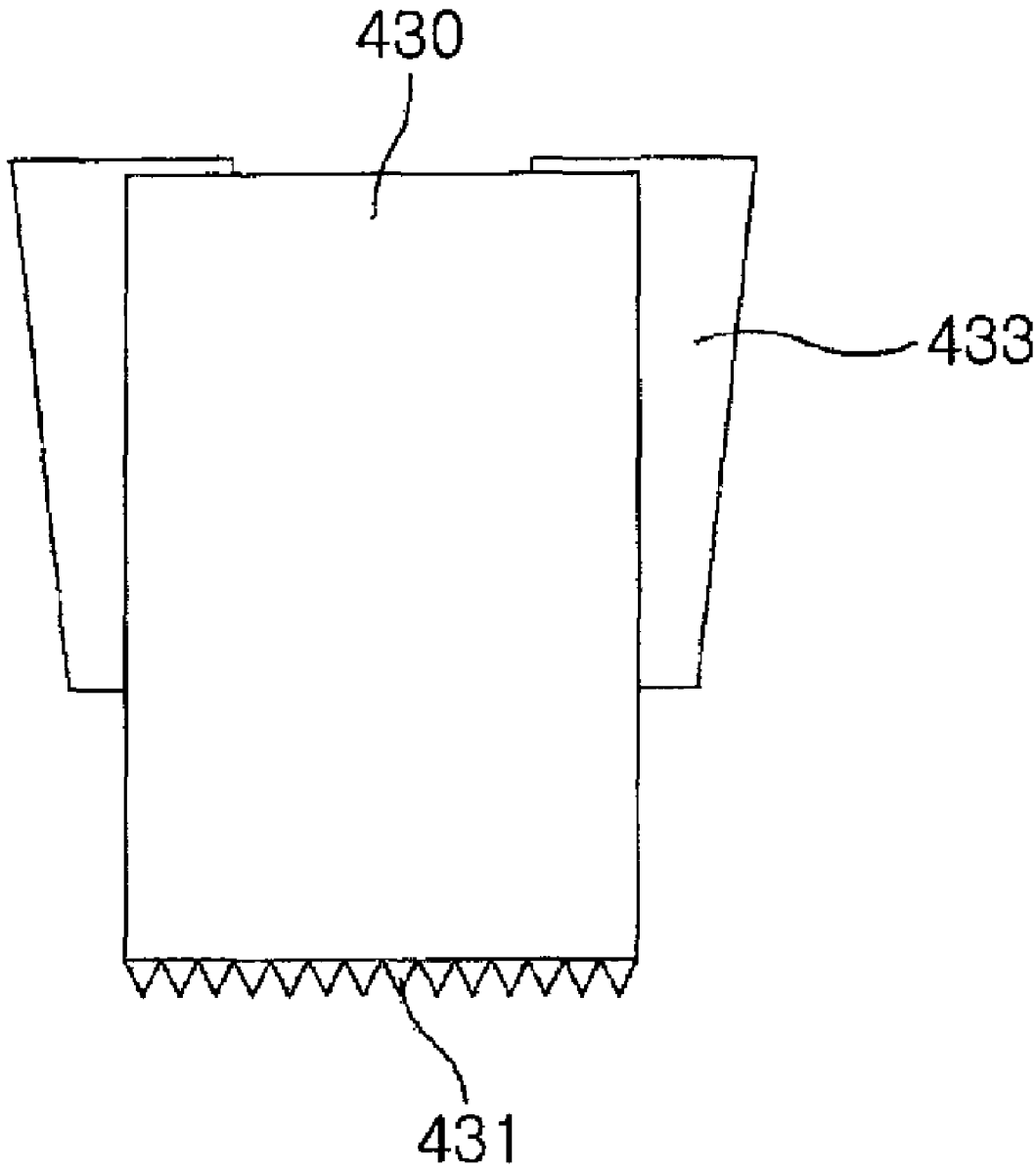

Meanwhile, FIGS. 22 to 24 illustrate a modified rotation preventing member. That is, in the case of a rotation preventing member 230 shown in FIG. 22, a lock 221 with a protrusion engaging portion 231*a* and a lock adjuster 233 with a male screw portion 233*a* are joined to each other not by a magnetic force but by a rivet 235.

In the case of a rotation preventing member 330 shown in FIG. 23, a lock and a lock adjuster are formed as one body. A protrusion engaging portion 331 is formed on the bottom of rotation preventing member 330, which is tapered to decrease a cross-sectional area from the top to the bottom. Rotation preventing member 330 is pressed and fixed to mounting portion 34 of rocker arm 30. In this case, the female screw portion may be formed or not formed on the inner circumferential surface of mounting portion 34.

A rotation preventing member 430 shown in FIG. 24 has a quadrangle cross-sectional shape and includes a protrusion engaging portion 431 formed on the bottom thereof. After rotation preventing member 430 is inserted into mounting portion 34 of rocker arm 30, a key 433 fits in the circumference of rotation preventing member 430 and key 433 is pressed and fixed to mounting portion 34, such that rotation preventing member 430 is installed in mounting portion 34.

As described above, the shape and assembling method of the rotation preventing member are not limited to any one but may be variously modified.

Figure 25:
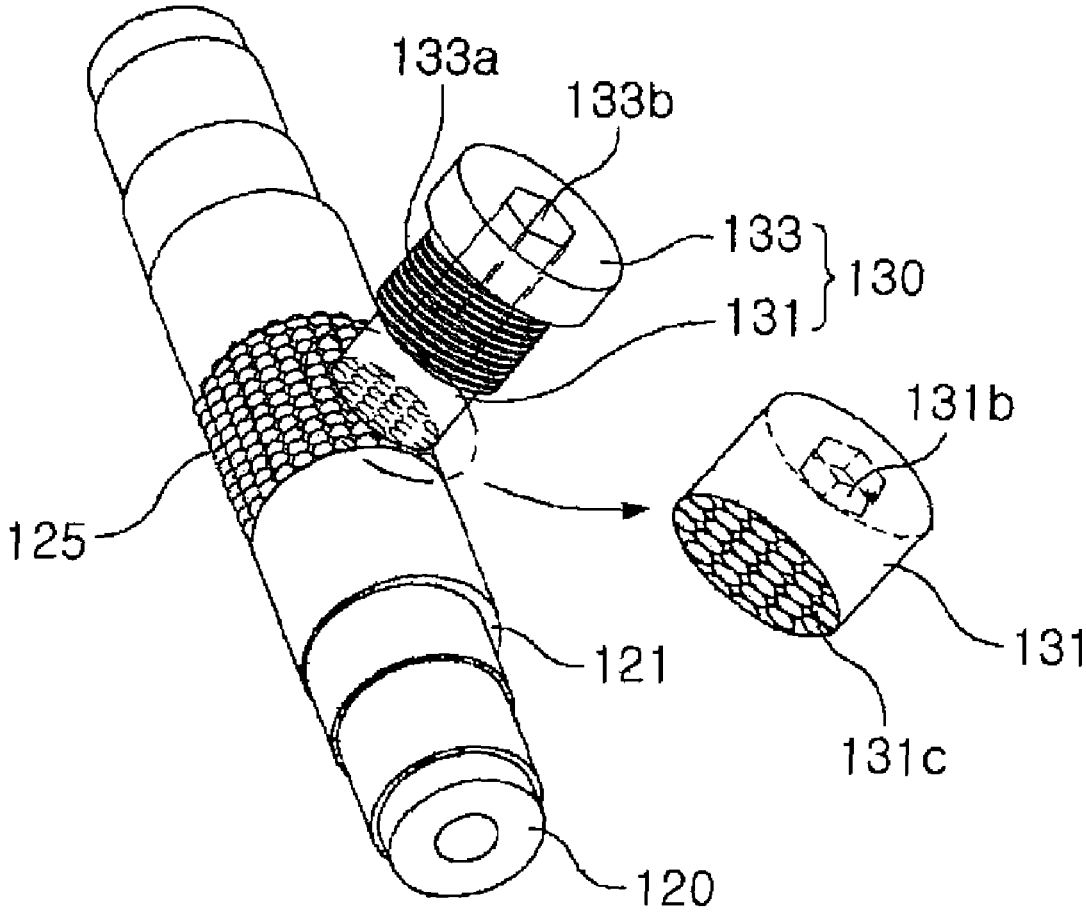
FIG. 25 is a diagram for illustrating a connection shaft and a rotation preventing member according to another embodiment.

Further, the embodiment shown in FIG. 25 and various embodiments can be applied to the protrusion provided in connection shaft 120 and the protrusion engaging portion provided in rotation preventing member 130.

That is, a protrusion 125 provided in connection shaft 120 has a hemisphere shape such as an embossing and is formed on an outer circumferential surface of pin cam 121 and a protrusion engaging portion 131*c* of rotation preventing member 130, which is provided on the bottom of lock 131 has a shape recessed on the bottom of lock 131, which is fitted with protrusion 125.

As described above, the shapes of the protrusion and the protrusion engaging portion are not limited to the gear shape or the embossing shape, but may have a shape to prevent the rotation of connection shaft 120 with being engaged with each other.

As described above, unlike the related art in which the rotation of connection shaft 120 was prevented by locking the nut to connection shaft 120, according to the present invention, the rotation of connection shaft 120 is prevented by just engaging protrusion 123 of connection shaft 120 and protrusion engaging portion 131*a* of rotation preventing member 130 with each other without using the nut, such that the operation can be conveniently performed even in an engine room having a narrow operation space.

In addition, since the transmission force of oscillating cam link 50 is not strongly applied to a part where protrusion 123 of connection shaft 120 and protrusion engaging portion 131*a* of rotation preventing member 130 are engaged with each other, the locking force between protrusion 123 and protrusion engaging portion 131*a* is strong, such that the clearance of oscillating cam link 50 can be maximally prevented from being accumulated.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the claims appended hereto and their equivalents.

What is claimed is:

1. A continuously variable valve lift system for engines comprising:

an eccentric cam connected to an eccentric cam shaft wherein a shaft center of the eccentric cam is offset from a shaft center of the eccentric cam shaft;

a rocker arm rotatably receiving the eccentric cam therein so that the rocker arm is eccentrically rotatable about the eccentric cam shaft according to rotation of the eccentric cam;

an oscillating cam rotatably coupled to the eccentric cam shaft;

an oscillating cam link pivotally coupling one end portion of the rocker arm and one end portion of the oscillating cam with each other;

a variable lever, one end portion of which is rotatably coupled to the eccentric cam shaft; and a link device linking the other end portion of the rocker arm and the other end portion of the variable lever with each other.

2. The system as defined in claim 1, further comprising:

an elastic member that elastically supports the oscillating cam toward a driving cam.

3. The system as defined in claim 1, wherein the one end portion of the rocker arm and one end portion of the oscillating cam link are connected to each other via a connection shaft and the rocker arm and the oscillating cam link are spaced from each other in a longitudinal direction of the connection shaft and are hinge-joined with the connection shaft.

4. The system as defined in claim 1, wherein the link device includes a variable lever link, one end portion of which is rotatably coupled to the other end portion of the rocker arm, a middle portion of which is rotatably coupled to the other end portion of the variable lever, and the other end portion of which contacts with a driving cam.

5. The system as defined in claim 1, wherein the link device includes:

a variable lever link, one end portion of which is hinge-joined to a variable lever link shaft coupled to the other end portion of the variable lever; and an oscillating roller link, one of which is rotatably coupled to the other end portion of the rocker arm and the other end portion of which is hinge-joined to the variable lever link.

6. The system as defined in claim 5, wherein an oscillating roller is installed at a connection portion between the variable lever link and the oscillating roller link.

7. The system as defined in claim 5, wherein the variable lever link shaft is hinge-joined with the other end portion of the variable lever.

8. The system as defined in claim 5, wherein the connection shaft and the variable lever link shaft are installed parallel to the eccentric cam shaft, respectively.

9. The system as defined in claim 5, wherein the oscillating roller is installed at the other end portion of the oscillating roller link.

10. A continuously variable valve lift system for engines comprising:

a link device that transmits rotational force of a driving cam to a link member to control a lift length of a valve;

an adjusting unit that connects the link member with the link device and is locked after adjusting tolerance between the link devices; and a rotation preventing member that is installed in the link member so as to be in contact and non-contact with the adjusting unit and prevents axial rotation of the adjusting unit when being in contact with the adjusting unit;

wherein a gear-shape or hemisphere-shape protrusion is formed in the adjusting unit in a circumferential direction or an axially longitudinal direction of the adjusting unit, and a protrusion engaging portion having a gear shape or a recessed groove shape that corresponds to the protrusion shape of the adjusting unit is formed in the rotation preventing member.

11. The system as defined in claim 10, wherein the link member is a rocker arm that rotatably receiving an eccentric cam installed to be eccentric to an eccentric cam shaft.

12. The system as defined in claim 10, wherein the link device is an oscillating cam link that interlocks the link member with an oscillating cam.

13. The system as defined in claim 10, wherein the adjusting unit includes a connection shaft that has a pin cam provided on an outer circumferential surface thereof to be eccentric and penetrates and connects the link member and the link device with each other so that the link device is positioned in the pin cam.

14. The system as defined in claim 10, wherein a protrusion that contacts the rotation preventing member is formed on an outer circumferential surface of the adjusting unit in a circumferential direction of the adjusting unit.

15. The system as defined in claim 10, wherein the rotation preventing member includes:

a lock that is inserted into and installed in a mounting portion of the link member and has a protrusion engaging portion engaged and joined with the adjusting unit, which is formed on the bottom thereof; and a lock adjuster that is integrally joined to the lock.

16. The system as defined in claim 10, wherein the rotation preventing member is screw-joined to the link member.

* * * * *